US008186281B2

(12) United States Patent
Bastian et al.

(10) Patent No.: US 8,186,281 B2
(45) Date of Patent: May 29, 2012

(54) MODULAR FURNITURE SYSTEM

(75) Inventors: John M. Bastian, Manitowoc, WI (US); Maurice Michaud, Green Bay, WI (US)

(73) Assignee: Fisher Hamilton L.L.C., Two Rivers, WI (US)

( * ) Notice: Subject to any disclaimer, the term of this patent is extended or adjusted under 35 U.S.C. 154(b) by 1102 days.

(21) Appl. No.: 11/276,525

(22) Filed: Mar. 3, 2006

(65) Prior Publication Data

US 2007/0204537 A1 Sep. 6, 2007

(51) Int. Cl.
*A47B 37/00* (2006.01)

(52) U.S. Cl. ..... 108/50.02

(58) Field of Classification Search ..... 312/223.6, 312/209; 108/50.01, 50.02, 107, 108, 109; 174/481, 68.1, 68.3, 72 A, 72 R
See application file for complete search history.

(56) References Cited

U.S. PATENT DOCUMENTS

| | | | | |
|---|---|---|---|---|
| D220,703 | S | 5/1971 | Deguchi | |
| 3,650,586 | A | 3/1972 | Nightingale et al. | |
| 3,920,299 | A | 11/1975 | Propst et al. | |
| 4,002,383 | A | 1/1977 | Holloway, Jr. | |
| D244,913 | S | 7/1977 | Brandenfels | |
| 4,050,752 | A * | 9/1977 | Dykstra | 312/243 |
| D257,093 | S | 9/1980 | Brittner | |
| 4,941,412 | A * | 7/1990 | Engel | 108/156 |
| D321,447 | S | 11/1991 | Newhouse | |
| D330,940 | S | 11/1992 | Engel | |
| 5,339,747 | A * | 8/1994 | Epps | 108/64 |
| D376,705 | S | 12/1996 | Stoddard et al. | |
| 5,638,759 | A * | 6/1997 | Klugkist | 108/50.02 |
| 5,879,185 | A * | 3/1999 | Handler et al. | 439/538 |
| 5,901,513 | A | 5/1999 | Mollenkopf et al. | |
| 5,997,397 | A | 12/1999 | Frickel et al. | |
| 6,029,832 | A | 2/2000 | Bastian | |
| 6,047,838 | A | 4/2000 | Rindoks et al. | |
| 6,112,913 | A | 9/2000 | Rindoks et al. | |
| 6,115,978 | A | 9/2000 | Bastian et al. | |
| 6,138,583 | A | 10/2000 | Mahone et al. | |
| 6,284,975 | B1 * | 9/2001 | McCord et al. | 174/71 R |
| 6,374,548 | B1 | 4/2002 | Ruedinger et al. | |
| D465,359 | S | 11/2002 | Kolberg | |
| D483,968 | S | 12/2003 | King et al. | |
| D508,343 | S | 8/2005 | Pflaster | |
| D587,485 | S | 3/2009 | Albright | |
| 7,634,967 | B1 * | 12/2009 | Albright et al. | 108/50.02 |
| 7,712,847 | B1 * | 5/2010 | Albright et al. | 312/209 |
| 7,735,433 | B1 * | 6/2010 | Albright et al. | 108/153.1 |
| 2003/0089283 | A1 * | 5/2003 | Okamoto et al. | 108/50.02 |
| 2005/0183874 | A1 * | 8/2005 | Vargas et al. | 174/53 |

OTHER PUBLICATIONS

Fisher Hamilton L.L.C., Distinction, Laboratory Bench System, Jan. 2005, 8 pages.
Fisher Hamilton L.L.C., MAX/Wall, Technical Wall System, May 2002, 12 pages.

* cited by examiner

*Primary Examiner* — Jose V Chen
*Assistant Examiner* — Matthew Ing
(74) *Attorney, Agent, or Firm* — Wood, Herron & Evans, LLP

(57) ABSTRACT

A modular furniture system includes a framework assembly comprising vertical and horizontal frame members that can be shared by back-to-back workstations. The vertical and horizontal frame members are configured to facilitate routing of various utility service lines through the framework assembly to locations near the workstations. In another embodiment, a horizontal frame member facilitates routing of electric service wires to outlets near the workstations, while concealing fasteners and other structure of the outlets.

43 Claims, 19 Drawing Sheets

MODULAR FURNITURE SYSTEM

FIELD OF THE INVENTION

The present invention relates generally to furniture systems and, more particularly, to a modular furniture system suitable for use in various commercial and industrial environments.

BACKGROUND OF THE INVENTION

Modular furniture systems that can be configured and reconfigured to meet particular user requirements are desirable in many applications and environments such as laboratories, product inspection stations, manufacturing assembly stations, and clean rooms, for example. Typically, such modular furniture systems include a tabletop, or other generally planar work surface, and may be adapted to support shelving, drawers, dividers, tack boards, and various other accessories. In many applications it is also desirable to provide various utility services, such as electric, data, gas, fluid and vacuum services, at or near the work surface to facilitate the performance of various tasks.

Conventional modular furniture systems generally include framework assemblies supporting the work surfaces and various other components of the furniture systems. Some furniture systems can be configured to combine multiple work surfaces adjacent one another, generally by connecting the components of individual workstations. This results in redundant, duplicated components. Conventional furniture systems are also typically difficult to assemble and to reconfigure for specific uses, particularly when it is desired to add or modify various utilities services provided to a work surface.

Accordingly, further improvements to modular furniture systems can be made to improve the functionality of such systems while also improving their aesthetic appearance.

SUMMARY OF THE INVENTION

The present invention overcomes the foregoing and other shortcomings and drawbacks of modular furniture systems heretofore known for use in suitable various commercial and industrial environments. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a modular furniture system is provided including first and second back-to-back work surfaces defining respective first and second workstations. The work surfaces are supported by a shared or common framework including a pair of vertical frame members. At least one utility service line may be routed through the framework to provide utility service to the workstations, although in other embodiments utility service may not be provided for a particular workstation environment.

In another aspect of the present invention, at least one of the vertical frame members includes an elongate tubular section defining an interior channel therealong, and an open side that facilitates accessing the interior channel. A selectively removable panel is provided to cover the open side of the tubular section to enclose the interior channel.

In yet another aspect of the present invention, the modular furniture system further includes at least one partition disposed in the interior channel of the vertical frame member to define discrete passages along the interior channel. Utility service lines may be routed through the vertical frame member and contained within at least one of the discrete passages.

According to another aspect of the present invention, the modular furniture system includes at least one horizontal frame member extending between the pair of vertical frame members. The horizontal frame member has a first side generally facing the first workstation and a second side generally facing the second workstation. First and second electric service outlets may be provided on the horizontal frame member with a first electric service outlet associated with the first side of the horizontal frame member and facing the first workstation, and a second electric service outlet associated with the second side of the horizontal frame member and facing the second workstation. The first and second electric service outlets can be mounted within the horizontal frame member such that fasteners used to mount the electric service outlets are concealed from view externally of the horizontal frame member.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION OF THE PREFERRED EMBODIMENTS

Figure 1:
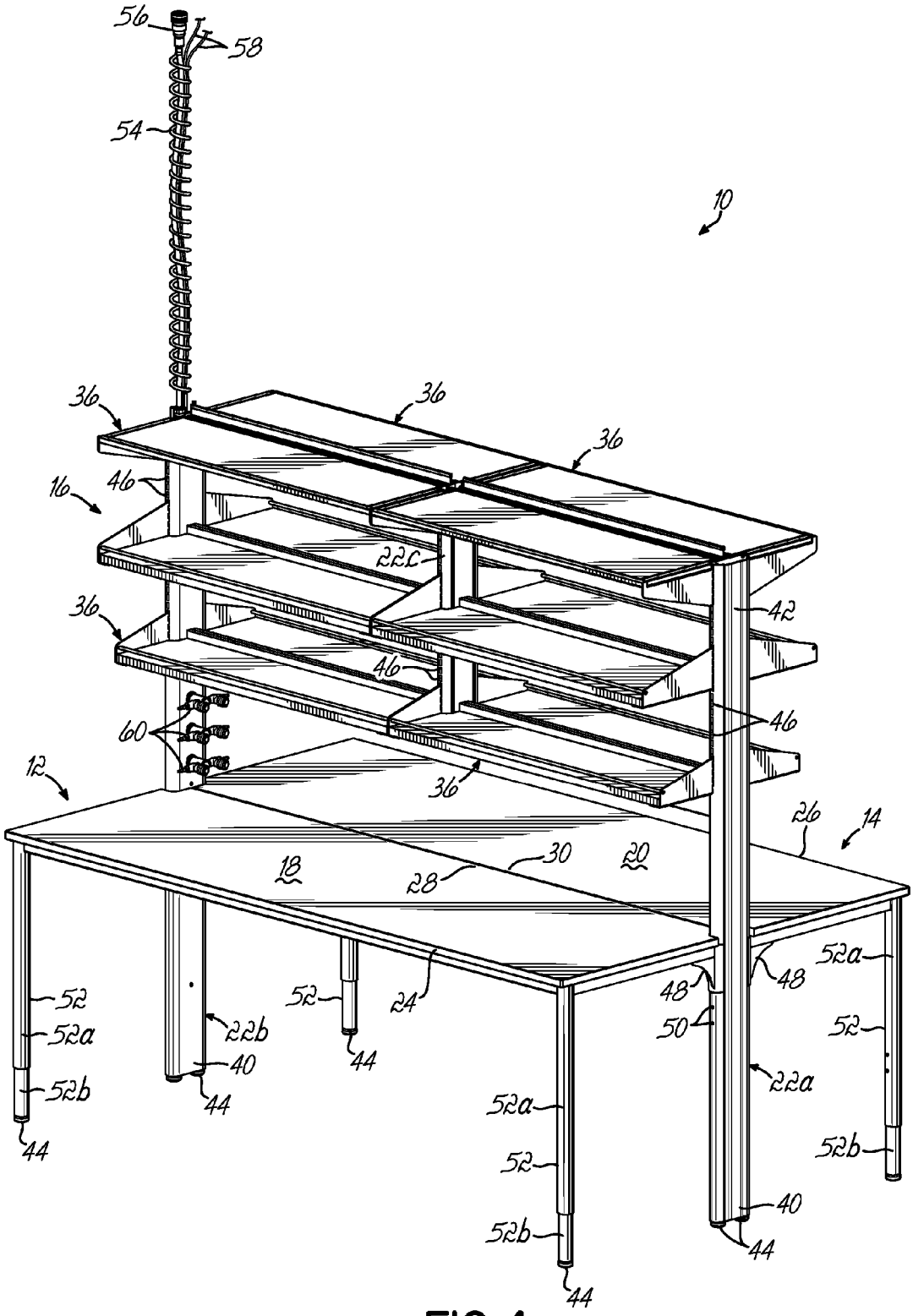
FIG. 1 is a perspective view of an exemplary modular furniture system in accordance with the principles of the present invention.

FIG. 1 depicts an exemplary modular furniture system 10 in accordance with the principles of the present invention. The modular furniture system 10 includes first and second workstations 12, 14 arranged back-to-back and sharing a common or unitary framework assembly 16. Each workstation 12, 14 includes a generally planar work surface, or tabletop, 18, 20 which is at least partially supported by vertical frame members 22*a*, 22*b* of the framework assembly 16. In this embodiment, each work surface 18, 20 have oppositely disposed first and second side edges 24, 26, 28, 30. The work surfaces 18, 20 are arranged back-to-back such that the first side edges 24, 26 face away from one another and the second side edges 28, 30 are disposed adjacent one another or, alternatively, generally abut one another.

Figure 1A:
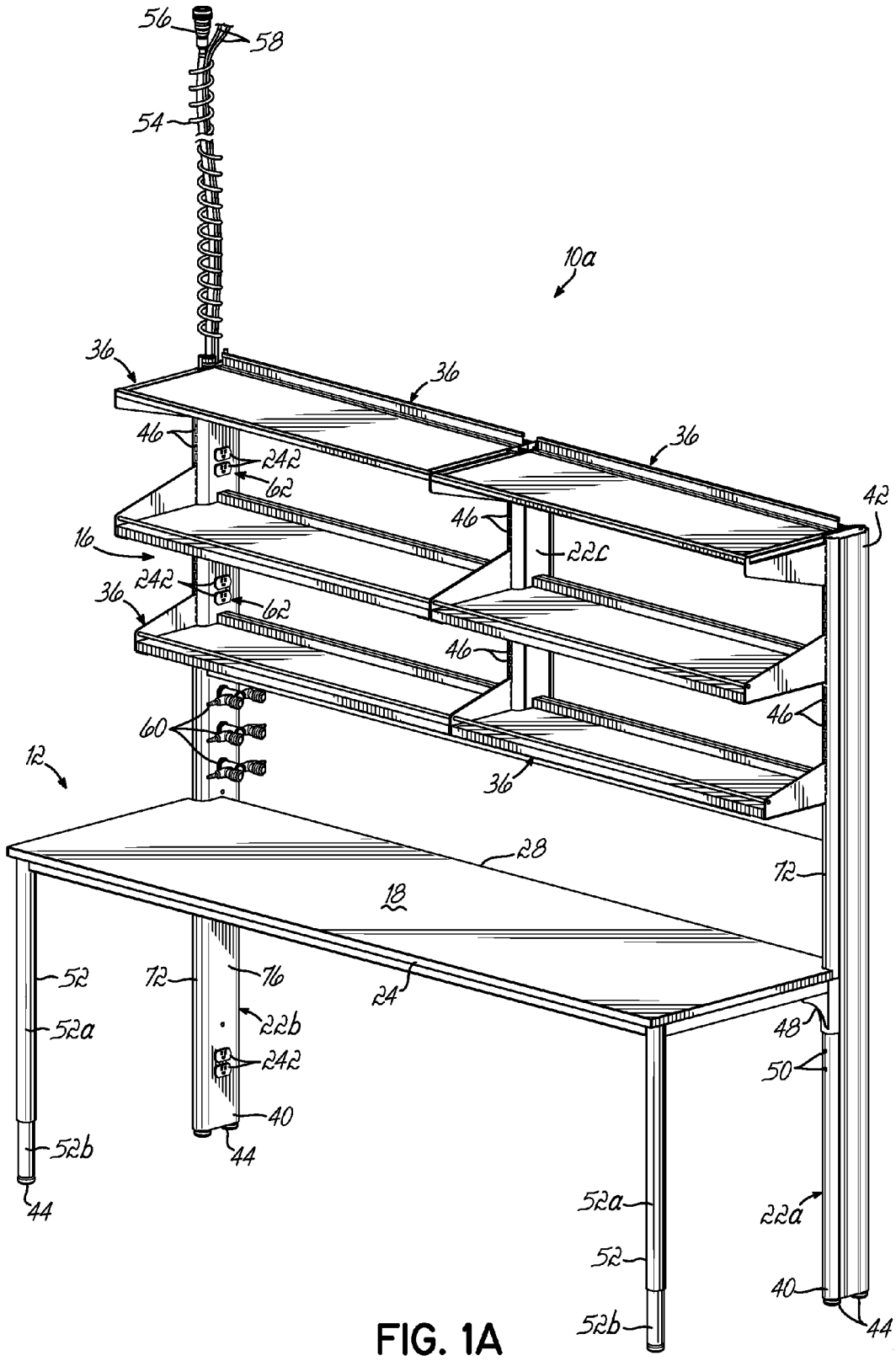
FIG. 1A is a perspective view of another modular furniture system, similar to the furniture system FIG. 1, but having a single workstation.

FIG. 1A depicts an alternative embodiment of an exemplary modular furniture system 10*a*, similar to the modular furniture system 10 of FIG.1, but wherein a single workstation 12 is supported by the framework assembly 16. This embodiment is suitable for location along a wall or partition when it is not desired to have a second workstation 14 provided along the second side edge 28.

In the embodiments shown and described herein, various components of the framework assembly 16 may be formed from sheet metal that has been cut, stamped, bent, welded, or otherwise worked to form the components. Alternatively, it is contemplated that one or more of the components of the framework assembly 16 may comprise extruded aluminum. It will be recognized, however, that the components may alternatively be formed from various other materials and by various other methods, and the invention is not limited to the particular embodiments described herein.

Figure 2:
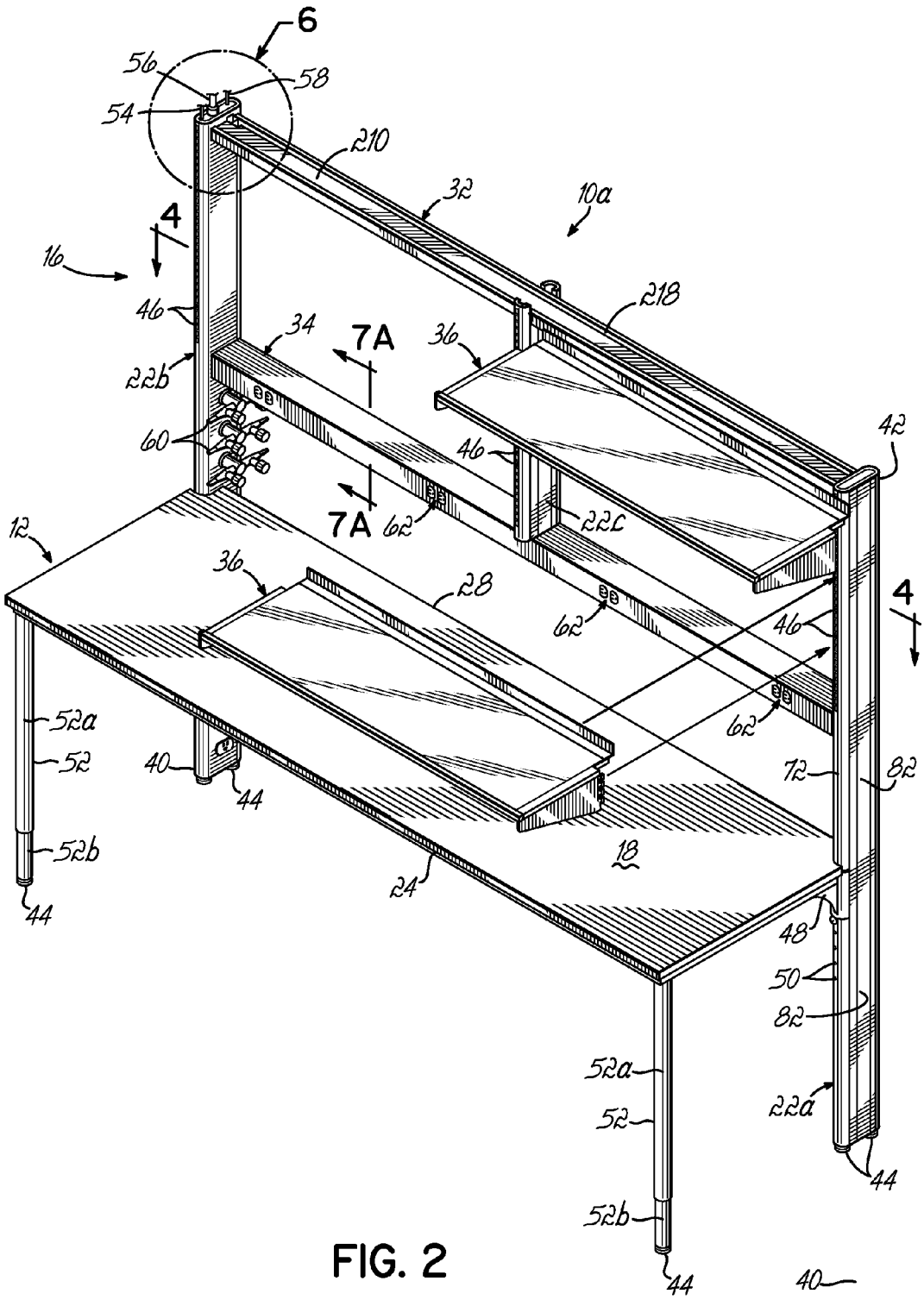
FIG. 2 is a perspective view of the modular furniture system of FIG. 1A, with shelving removed to illustrate structural detail.

With continued reference to FIGS. 1 and 1A, and referring further to FIG. 2, the framework assembly 16 comprises, in one embodiment, vertical frame members 22*a*, 22*b*, 22*c* and horizontal frame members 32, 34 (FIG. 2) that are joined together to form a support structure for the modular furniture system 10, 10*a*. Vertical frame members 22*a*, 22*b* of the framework assembly 16 comprise elongate tubular sections having ends 40 adapted to engage a floor surface, and oppositely disposed ends 42 extending upwardly toward the top of the modular furniture system 10, 10*a*. An intermediate vertical frame member 22*c* may be positioned between the first vertical frame members 22*a*, 22*b* and spans between horizontal frame members 32, 34. Feet or furniture glides 44 may be provided on the ends 40 of the first vertical frame members 22*a*, 22*b* to protect the floor surface. In the embodiment shown, the vertical frame members 22*a*, 22*b* have generally oblong or ovate cross-sectional geometries, as will be described in more detail below, to provide a novel and visually distinctive appearance to the modular furniture system 10.

A plurality of apertures 46 are provided proximate the ends 42 of the vertical frame members 22*a*, 22*b* and are arranged to extend lengthwise along the vertical frame members 22*a*, 22*b* in directions toward the first ends 40. Groups of the apertures 46 are provided on oppositely disposed sides of the vertical frame members 22*a*, 22*b* to face the respective first and second workstations 12, 14 whereby work surfaces 18, 20 and shelves 36 may be secured to both sides of the framework assembly 16 and supported by the shared vertical frame members 22*a*, 22*b*. Apertures 46 may also be used to secure and support cabinets, tack boards, dividers and various other accessories (not shown) on both sides of the shared vertical frame members 22*a*, 22*b*. When it is desired to have shelves 36 or other accessories that do not extend the entire span between the first vertical frame members 22*a*, 22*b*, the furniture system 10, 10*a* may be provided with an intermediate vertical frame member 22*c* with corresponding apertures 46 to serve as an intermediate support for such accessories.

In the embodiments shown, the side edges 28, 30 of the work surfaces 18, 20 are secured to the vertical frame members 22*a*, 22*b* by height-adjustable brackets 48. The brackets 48 may be selectively positioned in any of a plurality of apertures 50 provided on the oppositely disposed sides of the vertical frame members 22*a*, 22*b*. The side edges 24, 26 of the work surfaces 18, 20 are supported by legs 52 comprising first and second telescopingly adjustable leg portions 52*a*, 52*b* that may be set to lengths corresponding to the positions of the brackets 48, whereby the heights of the work surfaces 18, 20 may be adjusted as desired.

The modular furniture system 10, 10*a* may be configured to provide various utility services to locations adjacent the work surfaces 18, 20, such as gas, liquid, vacuum, electric, and data services, for example. In the embodiments shown in FIGS, 1 and 1A, fluid service lines 54 for providing gas, liquid, or vacuum service, and electric and data service lines 56, 58 may be routed from a location above the furniture system 10, 10*a*, such as through a ceiling, for example, and through the framework assembly 16 to various fluid service fixtures 60 and outlets 62 (FIG. 2) provided on the framework assembly 16. Alternatively, the utility services may be routed from a floor, from a wall, or from various other locations provided in a building structure in which the furniture system 10, 10*a* may be located. In other embodiments, no utility services are provided as they may not be required for a particular workstation environment.

FIG. 2 depicts the modular furniture system 10*a* of FIG. 1A, with various shelves 36 removed to illustrate detail of the framework assembly 16. The framework assembly 16 will now be described more fully with reference to the modular furniture system 10*a* depicted in FIGS. 1A and 2. It will be understood, however, that this description of the exemplary framework assembly 16 also applies to the modular furniture system 10 depicted in FIG. 1, as well as various other embodiments in accordance with the principles of the present invention.

As discussed above, the framework assembly 16 includes vertical frame members 22*a*, 22*b*, 22*c* having apertures 46, 50 in two oppositely disposed sides for securing work surfaces 18, 20, shelves 36, and various other accessories to the modular framework assembly 16. The framework assembly 16 further includes horizontal frame members 32, 34 spanning between the vertical frame members 22*a*, 22*b*. The horizontal frame 32 member is provided proximate the upper ends 42 of the vertical frame members 22*a*, 22*b*, and the horizontal frame member 34 is spaced a distance beneath the horizontal frame member 32, but generally above the work surface 18. The horizontal frame members 32, 34 comprise generally elongate tubular sections which contribute to the stability and rigidity to the framework assembly 16. The horizontal frame members 32, 34 may also be used to route various conduits and wires of the utility service lines to desired locations on the modular furniture system 10, 10*a*.

Figure 3:
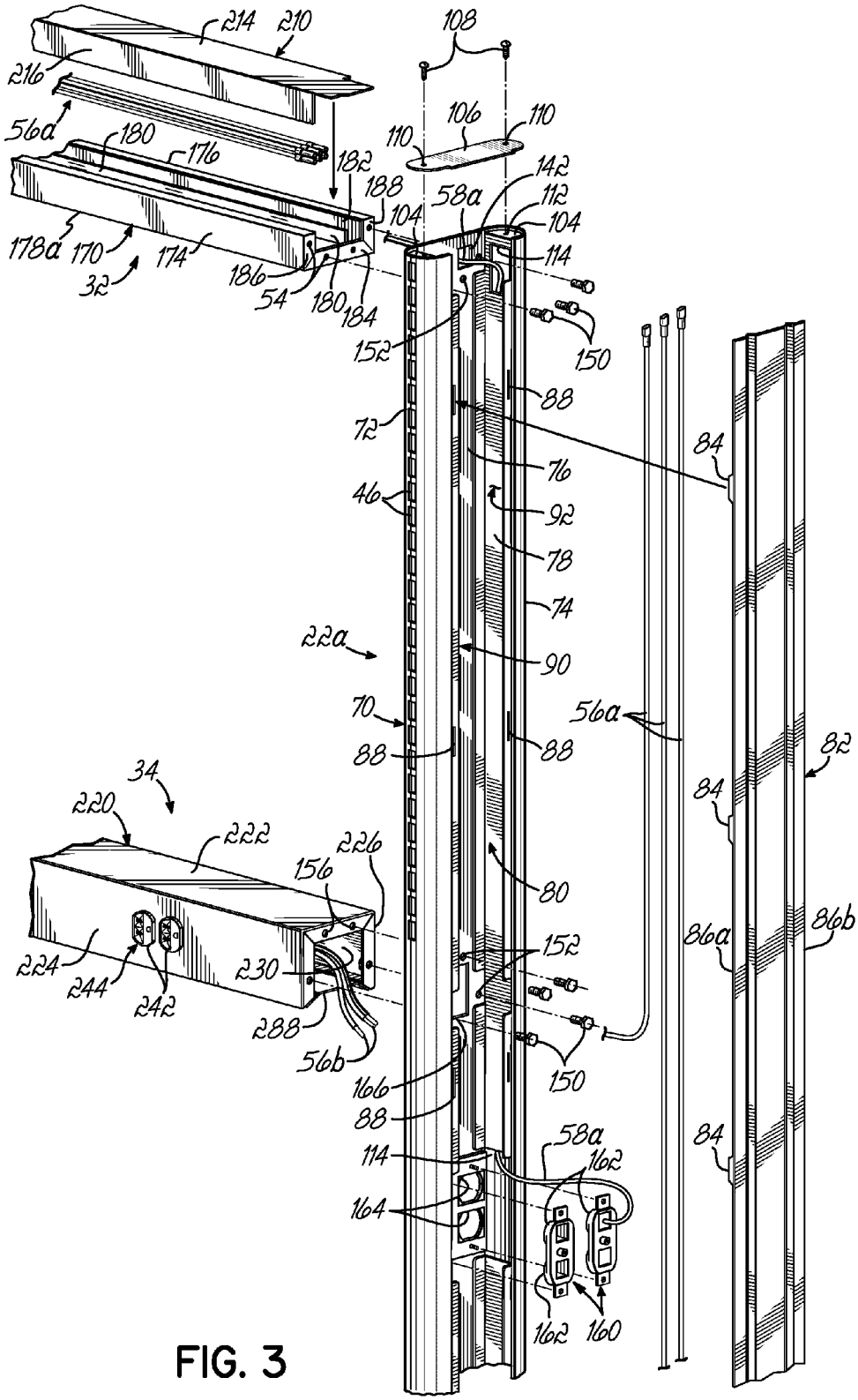
FIG. 3 is an exploded perspective view illustrating horizontal and vertical frame members of the modular furniture systems of FIGS. 1, 1A and 2.

FIG. 3 illustrates detail of an exemplary vertical frame member 22*a* and the horizontal frame members 32, 34 depicted in FIG. 2. The vertical frame member 22*a* comprises a generally elongate tubular section 70 having a generally oblong or ovate cross-sectional geometry. The tubular section 70 has generally rounded ends 72, 74 and a generally planar sidewall 76 extending therebetween. The vertical frame member 22*a* further includes an open side 78, generally opposite the sidewall 76 for providing access to an interior channel 80 defined by the generally rounded ends 72, 74 and the sidewall 76. The interior channel 80 may be used to route the fluid, electric, and data utility service lines 54, 56, 58 that may be provided to the modular furniture system 10, 10*a* so that the service lines are hidden from view but are readily accessible for service and/or reconfiguration as may be desired. A removable cover panel 82 is sized to cover the open side 78 of the tubular section 70 to enclose the service lines. The cover panel 82 may be secured to the elongate tubular section 70 by inserting tabs 84 formed along the outer edges 86*a*, 86*b* of the cover panel 82 into corresponding apertures 88 provided on the tubular section 70. It will be recognized, however, that various other methods and mechanisms for removably securing the cover 82 to the tubular section 70 may be used to enclose the utility service lines while permitting ready access as needed.

Figure 4:
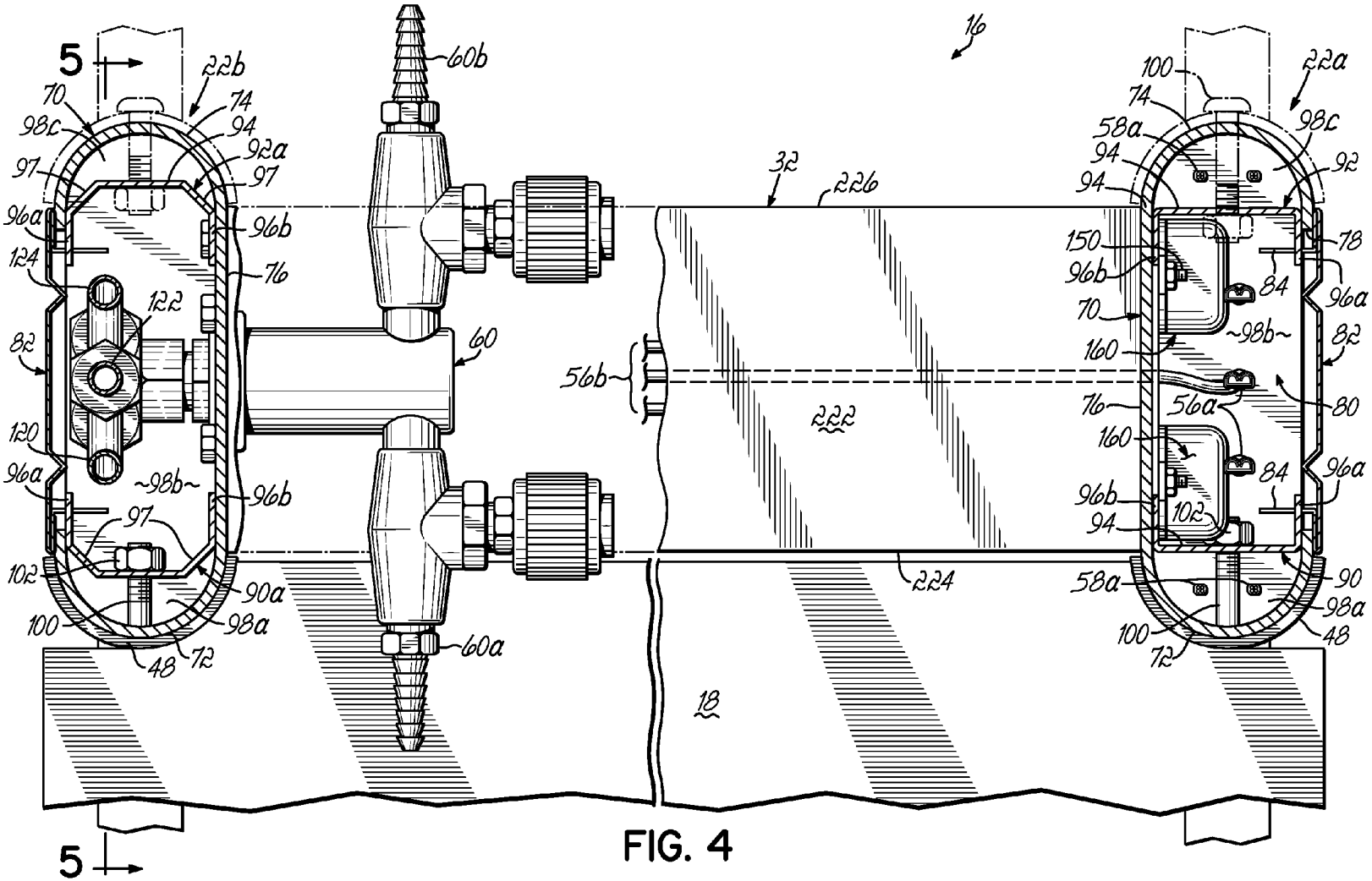
FIG. 4 is a partial cross-sectional view of the modular furniture system of FIG. 2, taken along line 4-4.

With continued reference to FIG. 3, and referring further to the right side of FIG. 4, the vertical frame member 22*a* further includes elongate partitions 90, 92 provided within the interior channel 80 and extending along at least portions of the elongate tubular section 70. Each partition 90, 92 comprises a generally planar partition wall 94 and oppositely disposed sidewalls 96*a*, 96*b* extending generally perpendicularly from the partition wall 94. The sidewalls 96*a*, 96*b* extend longitudinally along the partition wall 94 and are spaced apart to contact the surfaces of the interior channel 80. The partitions 90, 92 are positioned within the tubular section 70 proximate the ends generally rounded 72, 74 of the tubular section 70, and are spaced from the ends 72, 74 to define three distinct passages 98*a*, 98*b*, 98*c* along the interior channel 80. These distinct passages 98*a*, 98*b*, 98*c* may be used to generally isolate various utility service lines routed through the framework assembly 16, as may be desired. For example, the electric service lines 56 and data service lines 58 may be separated from one another by routing the respective wires 56*a*, 58*a* of these service lines along the passages 98*a*, 98*b*, 98*c* defined by the partitions 90, 92. In the embodiment shown, wires 58*a* of the data service lines 58 are routed along passages 98*a*, 98*c* that are defined between the respective partitions 90, 92 and the generally rounded ends 72, 74 of the tubular section 70. The wires 56*a* of electric service lines 56 are routed along the central passage 98*b*, disposed between the passages 98*a*, 98*c*.

The partitions 90, 92 may be secured to the generally rounded ends 72, 74 of the elongate tubular section 70 at desired locations along the interior channel 80, for example, by threaded fasteners, by welding, riveting, bonding with adhesives, or by various other methods suitable for securing the partitions 90, 92 to the tubular section 70. Threaded fasteners 100 and corresponding nuts 102 for mounting brackets 48 to legs 52 may be secured to the partitions 90, 92, as generally depicted in FIG. 4.

The distal ends of the partitions 90, 92, adjacent the ends 42 of the vertical frame members 22*a*, may include angled flanges 104 (FIG. 3) convenient for mounting an end plate or cap 106, to the end 42 of the vertical frame member 22*a*. In the embodiment shown, the end cap 106 is secured to the end 42 of the vertical frame member 22*a* by threaded fasteners 108 installed through corresponding apertures 110, 11 2 formed through the end cap 106 and the flanges 104 of the partitions 90, 92. One or more apertures 114 may be formed through the partition walls 94 of the partitions 90, 92 to facilitate routing service lines into and out of the passages 98*a*, 98*b*, 98*c* defined by the partitions 90, 92, as depicted in FIG. 3. Apertures or slots 88 may also be formed in the partition sidewalls 96*a* for receiving the tabs 84 of the cover panel 82, as described above.

The left side of FIG. 4 depicts the configuration of vertical frame member 22*b* and illustrates an alternative embodiment wherein partitions 90*a*, 92*a* disposed within interior channel 80 are formed in a different shape to maximize the volume of the passage 98*b*. Vertical frame member 22*b* is similar to the vertical frame member 22*a* described above, and similar features have been similarly numbered. In the embodiment shown, the partitions 90*a*, 92*a* have generally flat partition walls 94 and sidewalls 96*a*, 96*b*, but the partition walls 94 and sidewalls 96*a*, 96*b* are joined by angled connecting portions 97, whereby the partitions 90*a*, 92*a* may be positioned within the interior channel 80 with the partition walls 94 spaced closer to the generally rounded ends 72, 74 of the tubular section 70. This configuration provides a relatively larger passage 98*b* and may be desired when service lines 54, 56, 58 are routed through the vertical frame member 22*b* from a location above the modular furniture system 10, 10*a*. Such a configuration is used in the vertical frame member 22*b*, depicted on the left side of FIGS. 1, 1A and 2.

Figure 5:
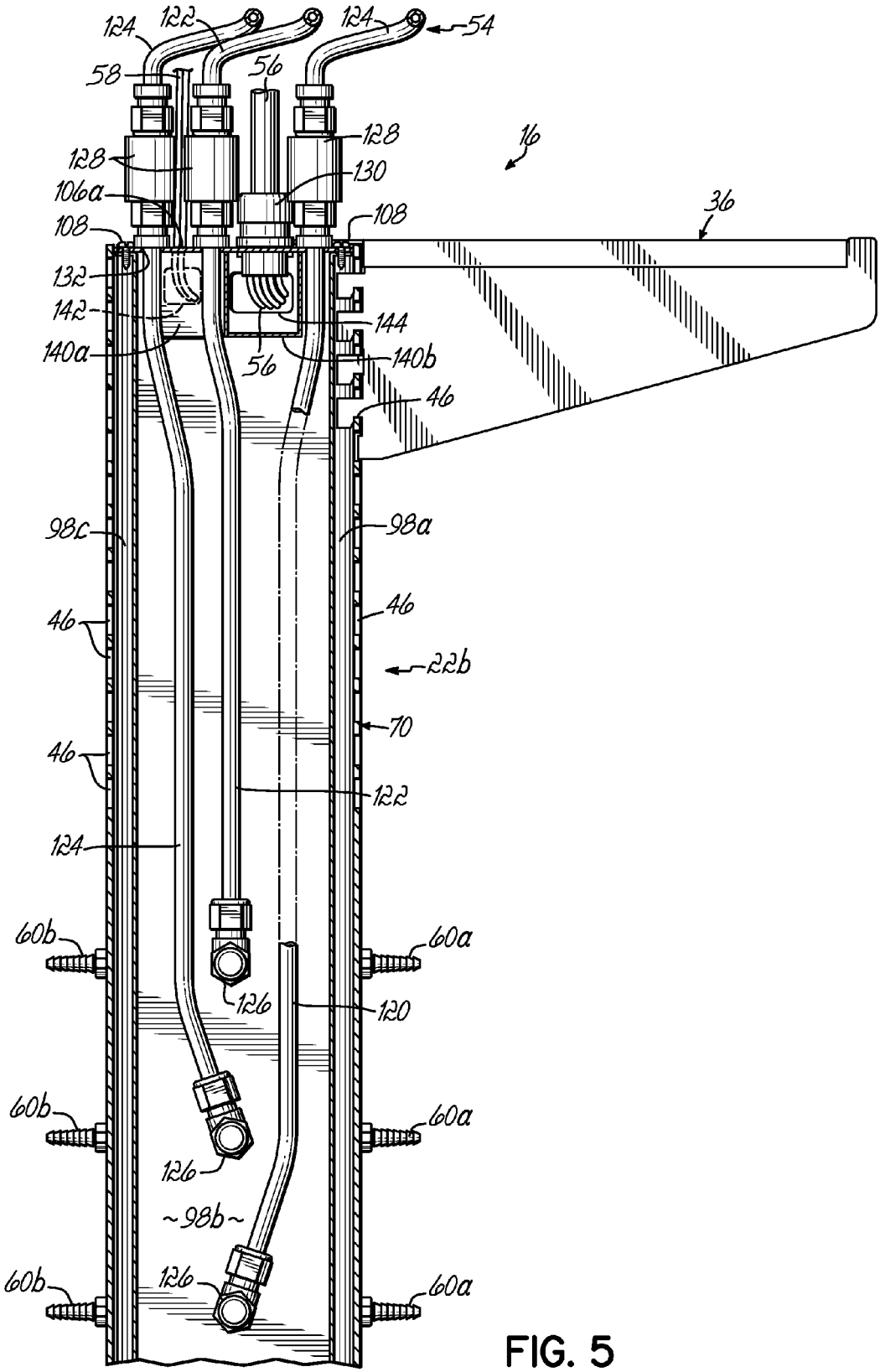
FIG. 5 is a cross-sectional elevation view taken along line 5-5 of FIG. 4.
Figure 6:
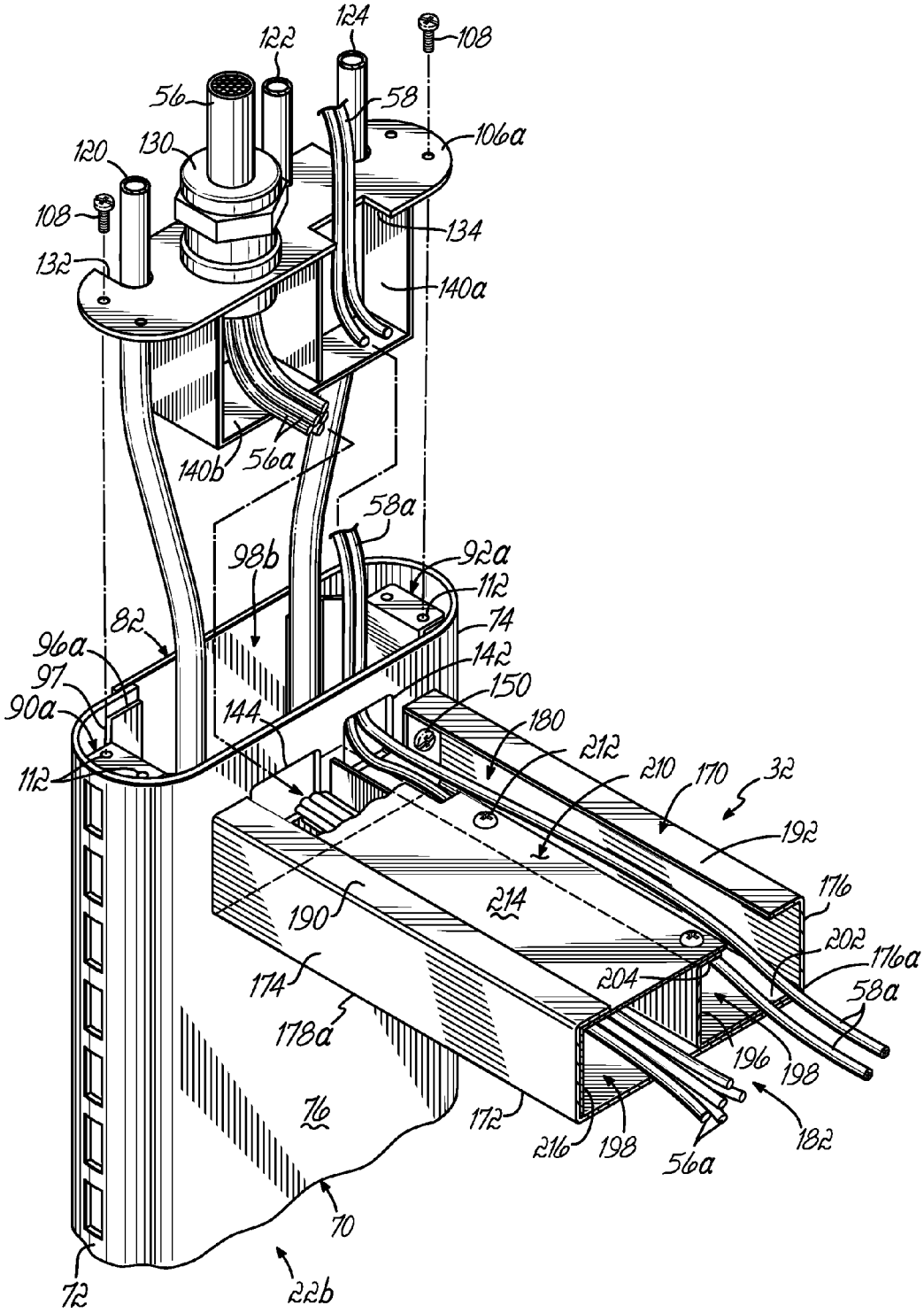
FIG. 6 is an exploded perspective view of the encircled area of FIG. 2, illustrating detail of a junction of horizontal and vertical frame members of the modular furniture system of FIG. 2.

With continued reference to FIG. 4 and referring further to FIGS. 5 and 6, fluid service line 54 includes three separate conduits 120, 122, 124 that extend through the end cap 106*a*. Conduits 120, 122, 124 are routed downwardly through the vertical frame member 22*b* and along the central passage 98*b* to couplings 126 communicating with respective fluid service fixtures 60 mounted along the vertical frame member 22*b* and proximate the work surface 18. Each fixture 60 includes valve controlled ports 60*a*, 60*b* for accessing the gas, liquid or vacuum service provided through the conduits 120, 122, 124. The conduits 120, 122, 124 may be divided into sections that are joined by quick-disconnect couplings 128 mounted to end cap 106*a* to facilitate installing and servicing the conduits 120, 122, 124. An electrical connector or ferrule 130 may also be provided on the end cap 106*a* to facilitate routing wires 56*a* from electric service line 56 into the second end 42 of the first vertical frame member 22*b*. Accordingly, the end cap is provided with corresponding gas service apertures 132 (FIG. 6) and electric service apertures (not shown) for receiving the couplings 128, 130 and service lines therethrough.

The end cap 106*a* may further include a data service aperture 134 for receiving data service lines 58 from a location above the modular furniture system 10, 10*a*. End cap 106*a* may also include one or more cable shrouds 140*a*, 140*b* for isolating the various service lines 54, 56, 58 received through the end cap 106*a*. In the embodiment shown, a generally rectangularly-shaped cable shroud 140*a* is provided adjacent the data service aperture 134 to isolate and facilitate routing the data service lines 58 through the data service aperture 134 in the end cap 106*a* and through a corresponding data service aperture 142 provided in the sidewall 76 of the elongate tubular section 70. Similarly, a generally rectangularly-shaped cable shroud 140*b* is provided on the end cap 106*a* for isolating and routing electric service wires 56*a* from electric service line 56 through the end cap 106*a* and through an electric service aperture 144 formed in the sidewall 76 of the elongate tubular section 70. Thereafter, the data service wires 58*a* and electric service wires 56*a* are routed along the horizontal frame member 32 to the opposite end of the horizontal frame member 32 where they are received into the opposite vertical frame member 22*a* and routed to desired locations, as illustrated in FIGS. 3 and 6, and described more fully below.

FIG. 3 also depicts exemplary embodiments of horizontal frame members 32, 34 of the framework assembly 16 and illustrates attachment of the horizontal frame members 32, 34 to the vertical frame member 22*a*. The horizontal frame members 32, 34 are attached at their opposite ends to vertical frame member 22*b* in a similar manner. In the embodiment shown, the terminal ends of the horizontal frame members 32, 34 are secured to the sidewall 76 of the tubular section 70 by threaded fasteners 150 received through a plurality of apertures 152 in the sidewall 76 and corresponding apertures 154, 156 formed in the ends of the horizontal frame members 32, 34. The sidewall 76 of the tubular section 70 further includes electric and data service apertures 142, 144 (FIG. 6), as described above with respect to vertical frame member 22*b*, to facilitate routing utility service lines to and from the horizontal frame members 32, 34 and into the passages 98*a*, 98*b*, 98*c* (FIG. 4) provided along the interior channel 80 of the first vertical frame member 22*a*.

Data service wires 58*a* extend through the data service aperture 142 provided in the sidewall 76 and into the aperture 114 formed in the partition wall 94 of the partition member 92, while electric service wires 56*a* are routed from the horizontal member 32 through the electric service aperture 144 provided in the sidewall 76. The electric service wires 56*a* are routed downwardly along the vertical frame member 22*a* and within the passage 98*b* (FIG. 4) to an electric service aperture 166 formed in the sidewall 76 of the tubular section 70. The electric service wires 56*a* may then be coupled to corresponding electric wires 56*b* extending within the horizontal frame member 34, as will be described in more detail below. Electric service wires 56*a* may also be routed to electric outlet sockets 242 provided on one or more of the vertical frame members 22*a*, 22*b*, as depicted in FIG.1A. Data service wires 58*a* are routed downwardly through the vertical frame member 22*a* and along the passage 98*c* to appropriate data outlets 160 having data ports 162 thereon. The data outlets 160 are mounted within the interior channel 80 of the vertical frame member 22*a* with the data ports 162 extending through data apertures 164 provided in the sidewall 76 of the tubular section 70 for convenient access from workstation 12 and/or workstation 14.

Figure 6A:
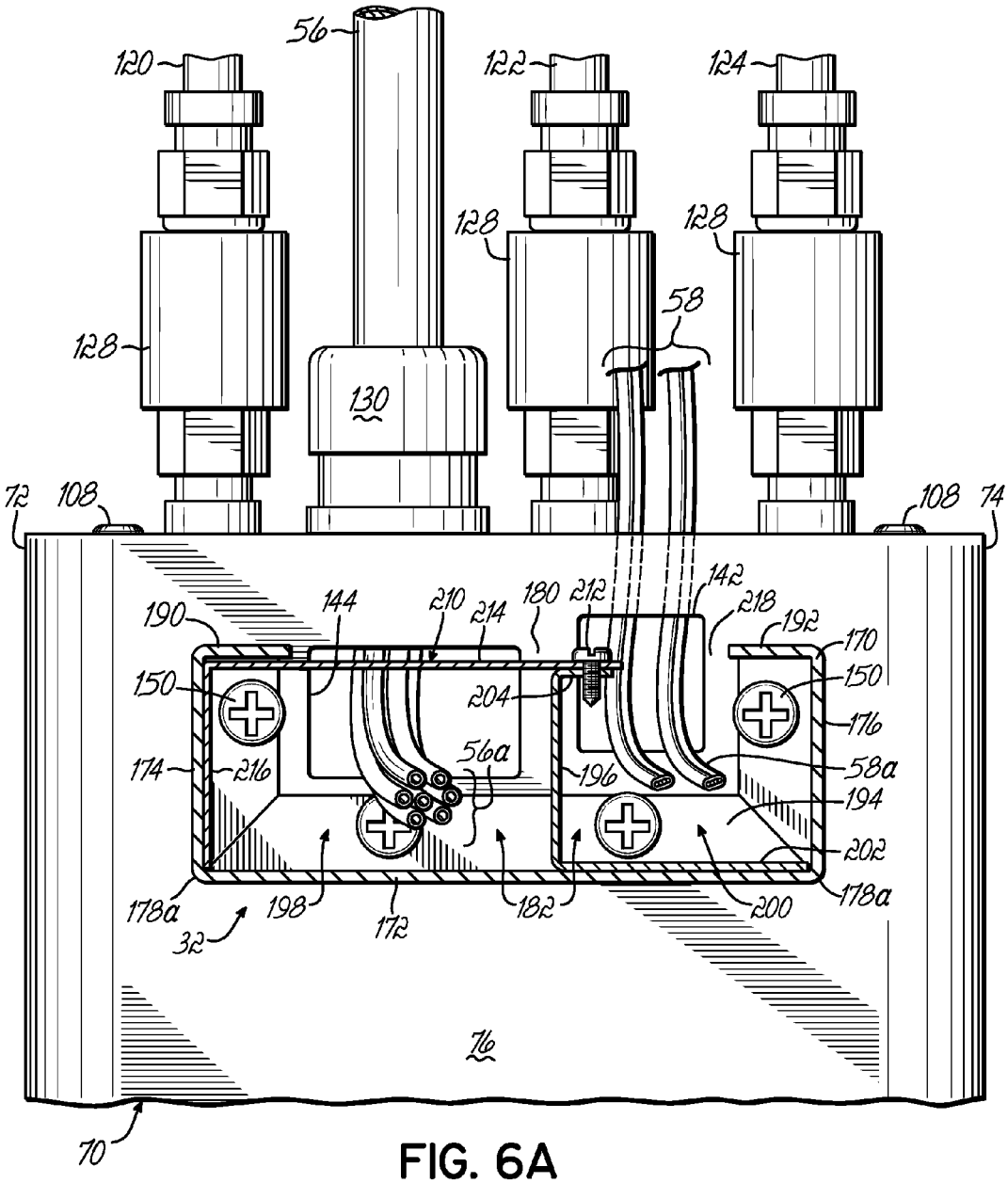
FIG. 6A is a cross-sectional elevation view of the horizontal and vertical frame members of FIG. 6.

With continued reference to FIGS. 3 and 6, and referring further to FIG. 6A, the horizontal frame member 32 comprises a generally elongate housing 170 having an end wall 172 and sidewalls 174, 176 provided along the respective longitudinal edges 178*a*, 178*b* of the end wall 172. The housing 170 further has an open side 180, generally opposite the end wall 172 and is oriented in the framework assembly 16 with the open side 180 facing upwardly, in a direction generally away from the work surface 18. The end wall 172 and sidewalls 174, 176 define an interior channel 182 along the horizontal frame member 32 for receiving utility service lines therein. Portions of the end wall 172 and sidewalls 174, 176 at the respective distal ends are bent to create end flanges 184, 186, 188. Apertures 154 are formed in the end flanges 184, 186, 188 for receiving fasteners 150 used to join the horizontal frame member 32 to the vertical frame members 22*a*, 22*b*, as described above. The upper side edges of the sidewalls 174, 176, opposite the end wall 172, are also bent to define flanged portions 190, 192 extending along the length of the horizontal frame member 32 to add rigidity to the housing 170.

The horizontal frame member 32 may further include one or more partitions extending along at least portions of the interior channel 182 to provide distinct passages therealong. In the embodiment shown, the horizontal frame member 32 includes a partition 194 having a partition wall 196 that defines passages 198, 200 along the interior channel 182. A bottom wall 202 extends from a bottom side edge of the partition wall 196, generally at an angle of approximately 90 degrees from the partition wall 196. When the partition 194 is placed within the interior channel 182, the bottom wall 202 engages the end wall 172 of the housing 170 and spaces the partition wall 196 from the second sidewall 176. A flange 204 is provided along the upper side edge of the partition wall 196 and extends from the partition wall 196 at an angle of approximately 90 degrees.

The horizontal frame member 32 further includes a cover plate 210 provided within the interior channel 182 and secured to the flange 204 of the partition wall 196 by threaded fasteners 212 installed through corresponding holes formed through the cover plate 210 and the flange 204. In the embodiment shown, the cover plate 210 is in the form of a generally elongate angled member having a top wall 214 and a sidewall 216 extending downwardly from the top wall 214 along a longitudinal side edge of the top wall 214. The sidewall 216 extends downwardly adjacent the sidewall 174 of the housing 170. In use, the partition 194 and cover plate 210 separate the electric and data service wires 56*a*, 58*a* and the cover plate 210 encloses the electric service wires 56*a* while the data service wires 58*a* remain accessible through an opening 218 between the partition wall 196 and the second sidewall 176.

With continued reference to FIG. 3 and referring further to FIGS. 7, 7A and 7B, the horizontal frame member 34 will now be described. In the embodiment shown, the horizontal frame member 34 comprises a generally elongate housing 220. The housing 220 comprises an upper wall 222 and opposing sidewalls 224, 226 extending downwardly from opposed lateral edges of the upper wall 222. The housing 220 has an open side 228 generally opposite the upper wall 222 and between the sidewalls 224, 226. The open side 228 provides access to an interior channel 230 defined by the upper wall 222 and the sidewalls 224, 226. Portions of the upper wall 222 and sidewalls 224, 226 at the respective distal ends of the housing 220 are bent to create flanges 232, 234, 236 having apertures 156 therethrough for receiving fasteners 150 for mounting the horizontal frame member 34 to the vertical frame members 22*a*, 22*b* as shown in FIG. 3 and discussed above. The lower longitudinal side edges of the sidewalls 224, 226, opposite the upper wall 222, are also bent to create flanges 238, 240 extending along the length of the housing 220. Outlet apertures 241 may be formed through one or both of the sidewalls 224, 226 to permit sockets 242 of electrical outlets 244, in this embodiment, duplex electrical outlets, to protrude therethrough for convenient access from the first and second workstations 12, 14. The electrical outlets 244 may be provided on one or both sides of the horizontal frame member 34.

The horizontal frame member 34 further includes outlet support members 250, 252 having apertures 243 for receiving and supporting the electrical outlets 244 within the housing 220, such that only the outlet sockets 242 protrude through the outlet apertures 241, while fasteners 245 and other structure of the outlets 244 are hidden from view to provide an aesthetically pleasing and visually distinctive appearance. In the embodiment shown, the outlet support members 250, 252 are slideably coupled together for movement between a first position (FIG. 7A) wherein the outlet support members 250, 252 are relatively closely spaced and can be received through the open side 228 of the housing 220 and into the interior channel 230, and a second position, wherein the outlet support members 250, 252 are spaced further apart such that they are positioned adjacent the sidewalls 224, 226, respectively, of the horizontal frame member 34 to be captured within the interior channel 230 of the housing 220 as depicted in FIG. 7B.

Figure 7:
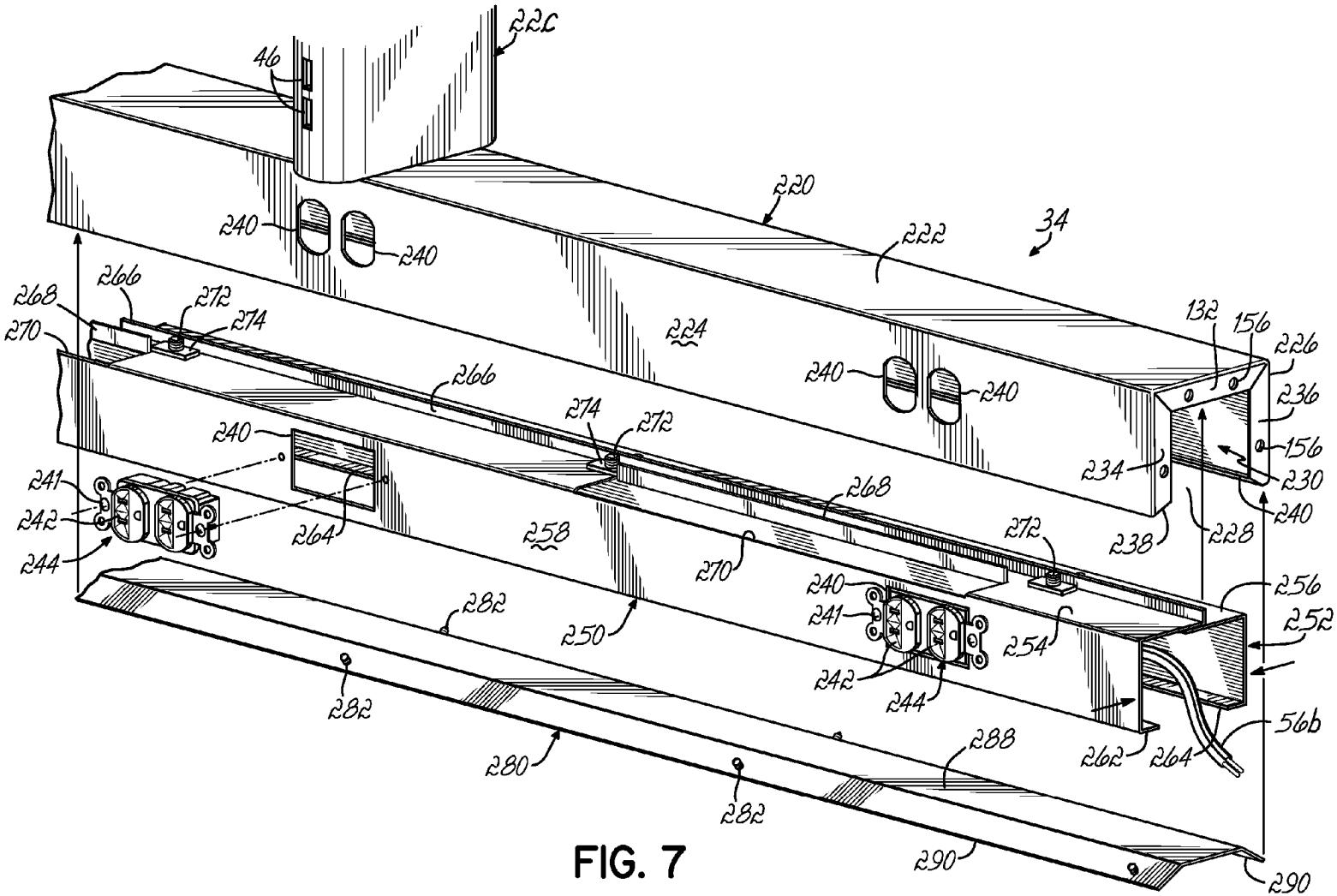
FIG. 7 is an exploded perspective view of a horizontal frame member of the modular furniture system of FIG. 2.
Figure 7A:
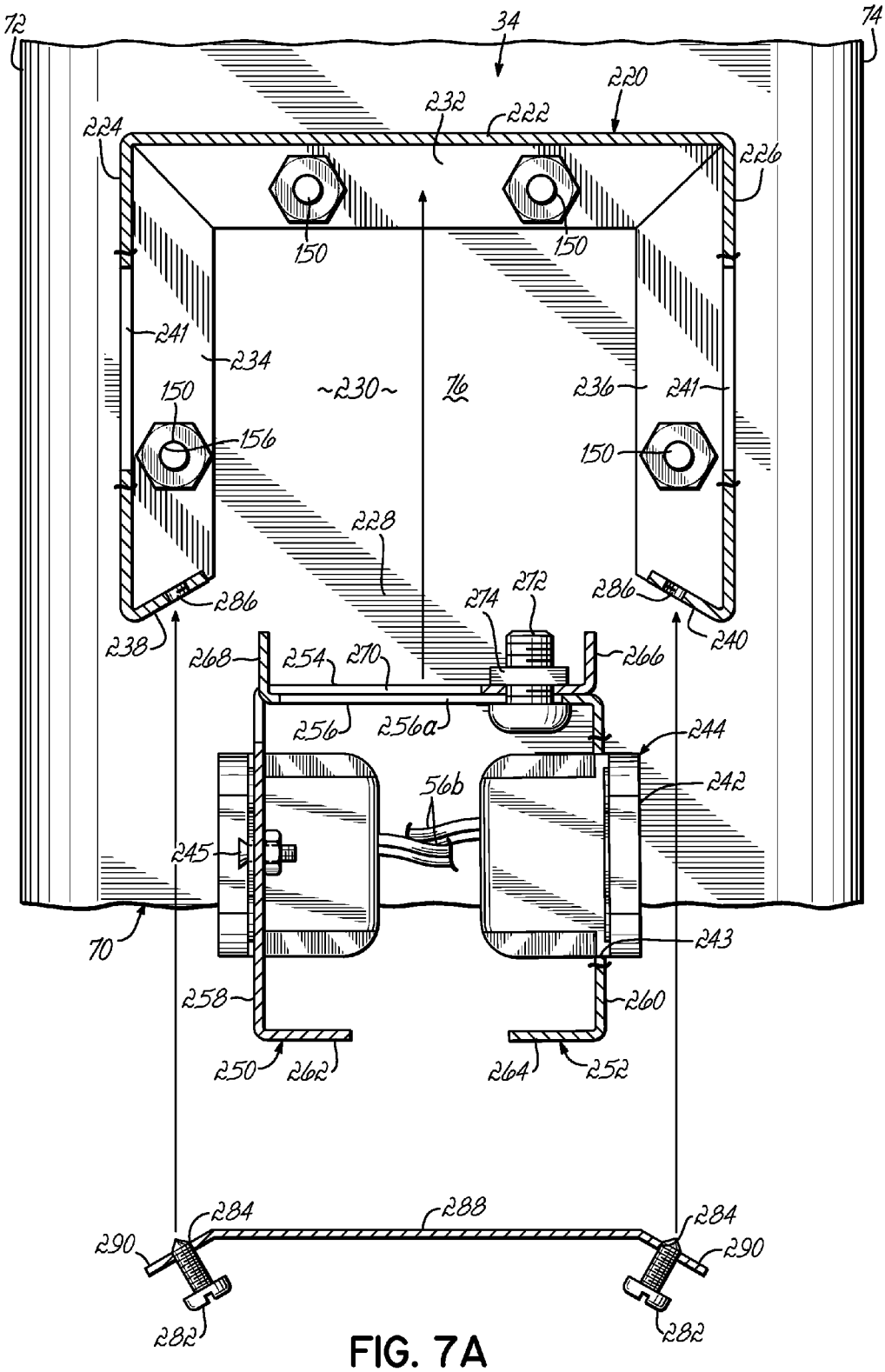
FIG. 7A is a cross-sectional elevation view of the horizontal frame member of FIG. 7.
Figure 7B:
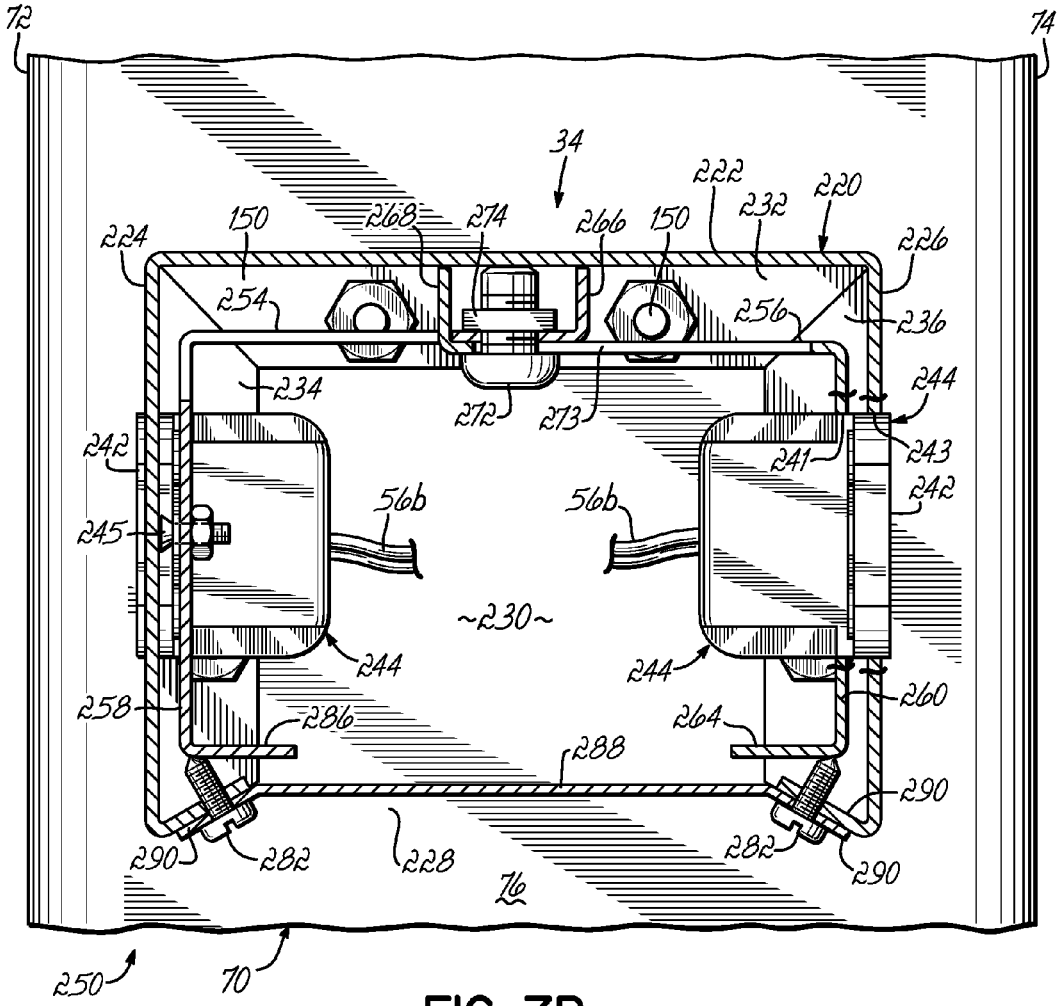
FIG. 7B is a cross-sectional elevation view of the horizontal frame member of FIG. 2 shown in an assembled state.

With reference to FIGS. 7 and 7A, the outlet support members 250, 252 comprise generally elongate angled sections having upper walls 254, 256 and downwardly extending sidewalls 258, 260. The lower longitudinal edges of the sidewalls 258, 260 of the outlet support members 250, 252 are bent in directions toward the respective upper walls 254, 256 and are substantially parallel to their respective upper walls 254, 256 to define elongate lower flanges 262, 264 extending along the lower longitudinal edges of the outlet support members 250, 252. The outer longitudinal edges of the upper walls 254, 256 are bent in directions generally away from the sidewalls 258, 260 such that they extend generally perpendicularly away from the respective upper walls 254, 256 to define elongate upper flanges 266, 268.

The upper flange 266 of the outlet support member 250 extends generally continuously along the upper edge of the outlet support member 250, while the upper flange 268 of the outlet support member 252 extends only along discrete intervals of the outlet support member 252 corresponding to the positions of rectangularly-shaped apertures 270 formed in the upper wall 254 of the outlet support member 250. When the outlet support members 250, 252 are coupled together as shown, the upper flange 268 of the outlet support member 252 extends through the apertures 270 formed in the upper wall 254 of the outlet support member 250. The outlet support members 250, 252 are secured by a plurality of threaded fasteners 272 installed through slots 273 in upper wall 256 and corresponding apertures (not shown) formed through upper wall 254 of the outlet support members 250, 252. The fasteners 272 threadably engage nut plates 274 provided atop the outlet support member 250, whereby the fasteners 272 may be tightened to securely clamp the respective upper walls 254, 256 of the outlet support members 250, 252 after the outlet support members 250, 252 have been installed within the interior channel 230 and moved to the second position, as depicted in FIG. 7B.

The horizontal frame member 24 further includes a generally elongate frame cover 280 sized to be received over the open side 228 of the housing 220 to enclose the electrical outlets 244 and corresponding electrical wires 56*b* routed therethrough. The horizontal frame cover 280 may be secured to the open side 228 of the housing 220 by threaded fasteners 282 installed through apertures 284 provided along longitudinal side edges thereof and corresponding apertures 286 formed through the lower flanges 238, 240 on the sidewalls of the housing 220. In the embodiment shown, the cover 280 comprises a generally planar central section 288 and longitudinal edge portions 290 which are bent at angles that correspond to the angles of the lower flanges 238, 240 on the sidewalls 224, 226 of the housing 220. The threaded fasteners 282 that secure the horizontal frame cover 280 to the open side 228 of the housing 220 may be configured to engage the lower flange portions 262, 264 of the outlet support members 250, 252 to provide resistance to movement of the electrical sockets 242 when electrical cords are attached and detached from the outlets 244.

Figure 8A:
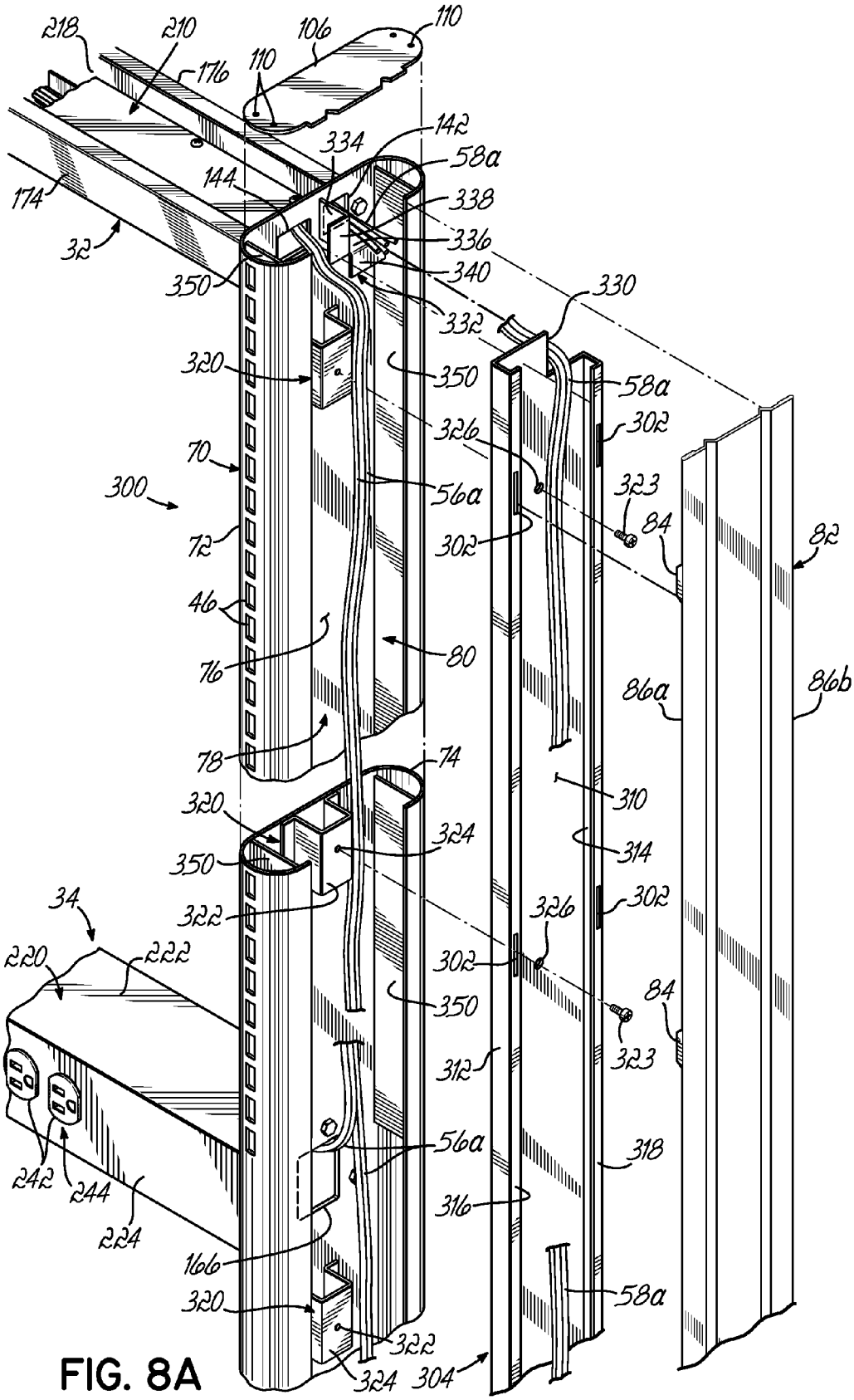
FIGS. 8A and 8B are exploded perspective views illustrating horizontal and vertical frame members of a modular furniture system of a second embodiment in accordance with the principles of the present invention.
Figure 8B:
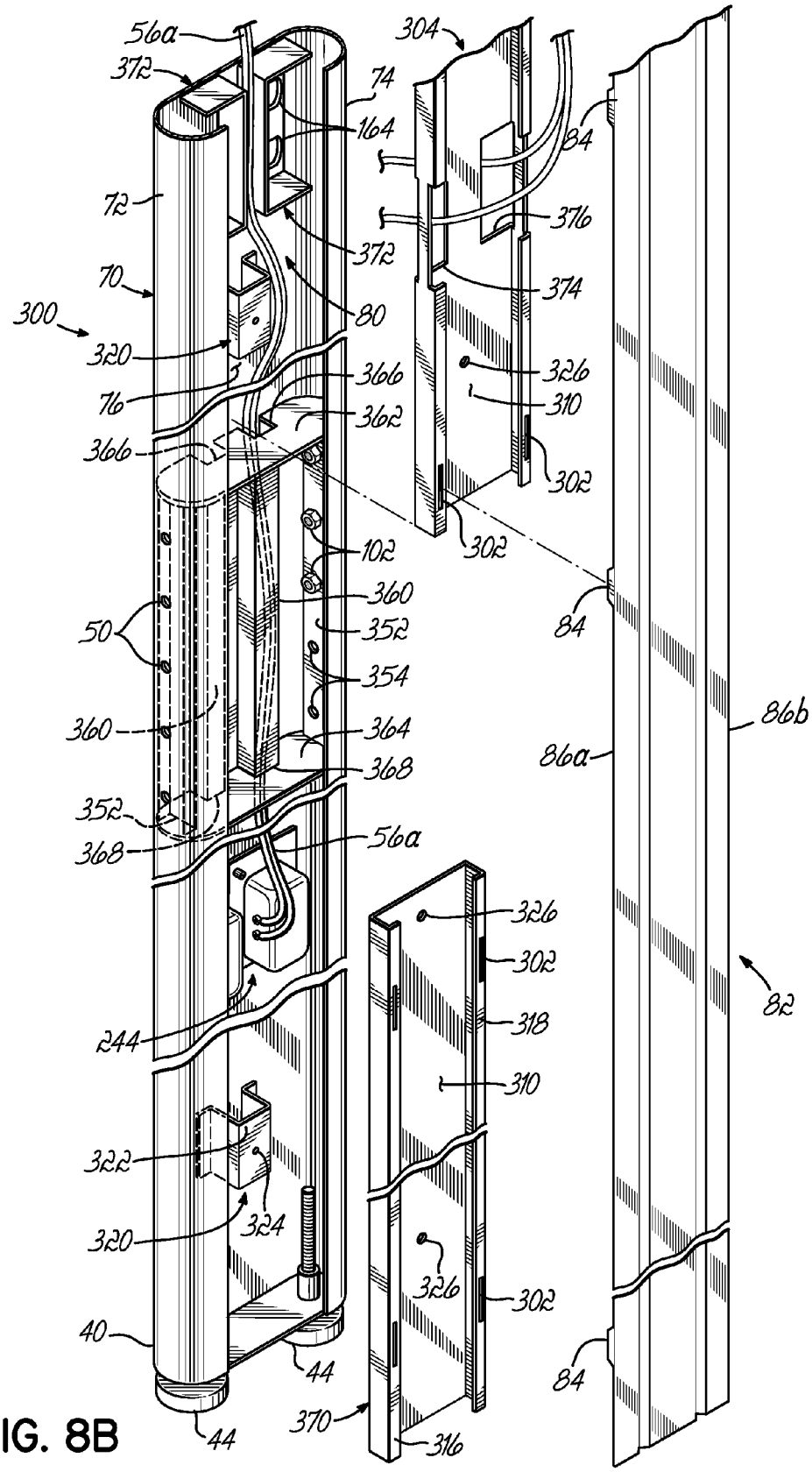

FIGS. 8A and 8B illustrate detail of another exemplary vertical frame member 300 in accordance with another embodiment of the present invention. The vertical frame member 300 comprises a generally elongate tubular section 70 having a generally oblong or obviate cross-sectional geometry, similar to the vertical frame member 22A described above, and like features have been correspondingly numbered. Horizontal frame members 32, 34 which are joined to the vertical frame member 300 are similar to those shown and described above. The tubular section 70 has generally rounded ends 72, 74 and a generally planar sidewall 76 extending therebetween. The vertical frame member 300 further includes an open side 78, generally opposite the sidewall 76 for providing access to an interior channel 80 defined by the generally rounded ends 72, 74 and the sidewall 76. The interior channel 80 may be used to route fluid, electric, and data utility service lines 54, 56, 58 that may be provided to the modular furniture system 10, 10A so that the service lines are hidden from view but are generally accessible for service and/or reconfiguration as may be desired. A removable cover panel 82 is sized to cover the open side 78 of the tubular section 70 to enclose the service lines. The cover panel 82 may be secured to the elongate tubular section 70 by inserting tabs 84 formed along the outer edges 86*a*, 86*b* of the cover panel 82 into corresponding apertures 302 associated with the tubular section 70, as will be described more fully below.

Figure 9A:
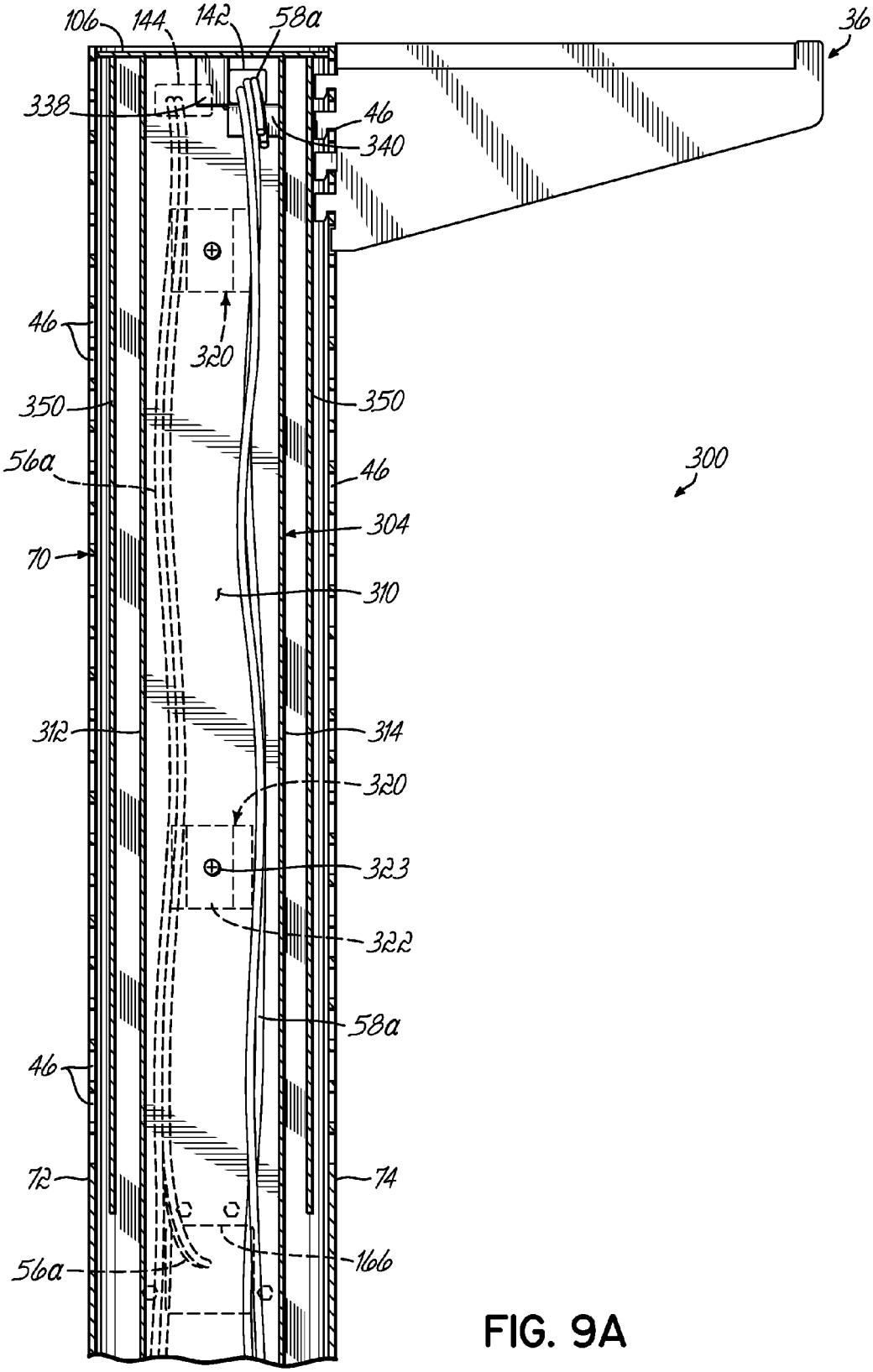
FIGS. 9A and 9B are cross-sectional elevation views of the vertical frame member of FIGS. 8A and 8B.
Figure 9B:
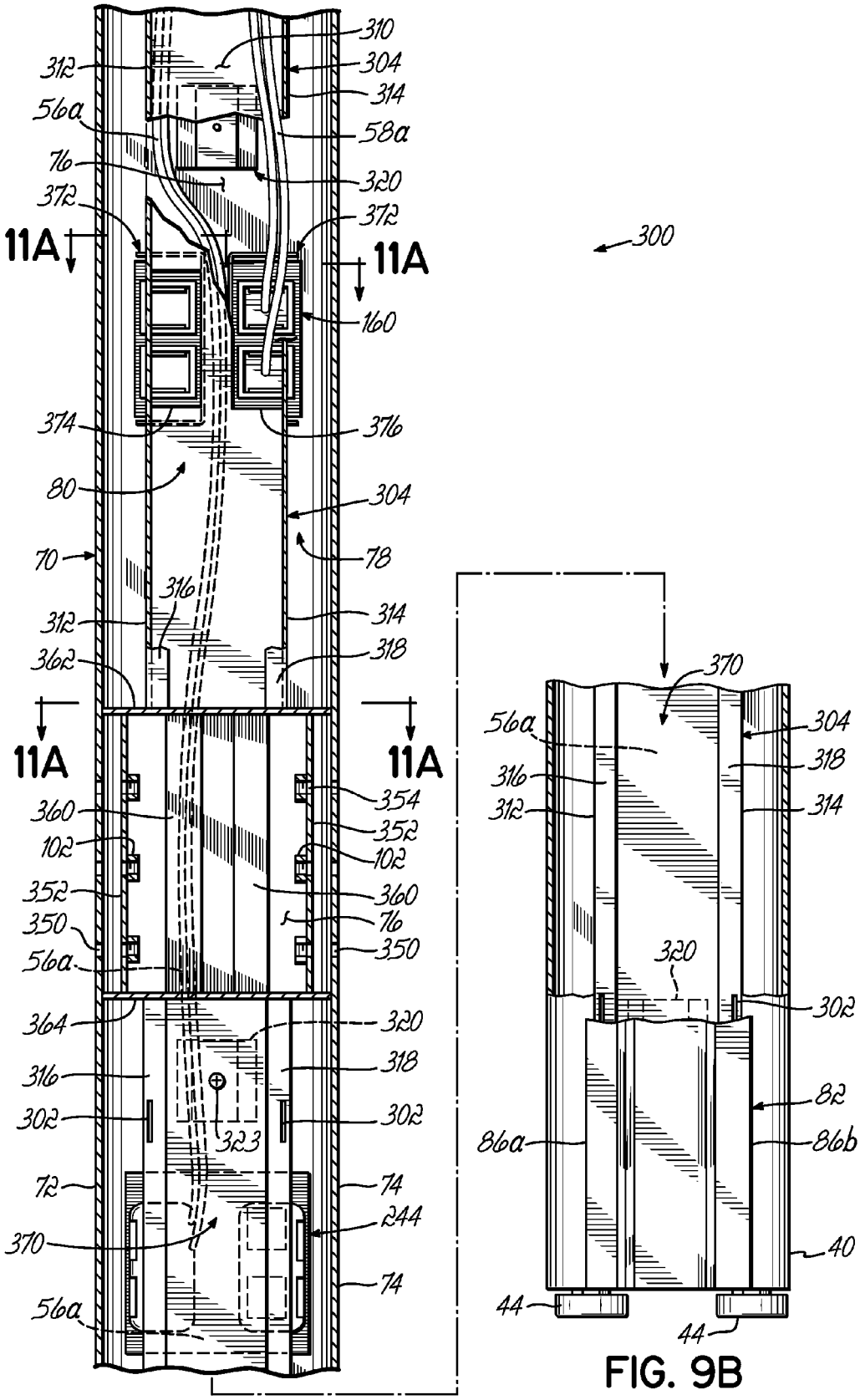
Figure 10:
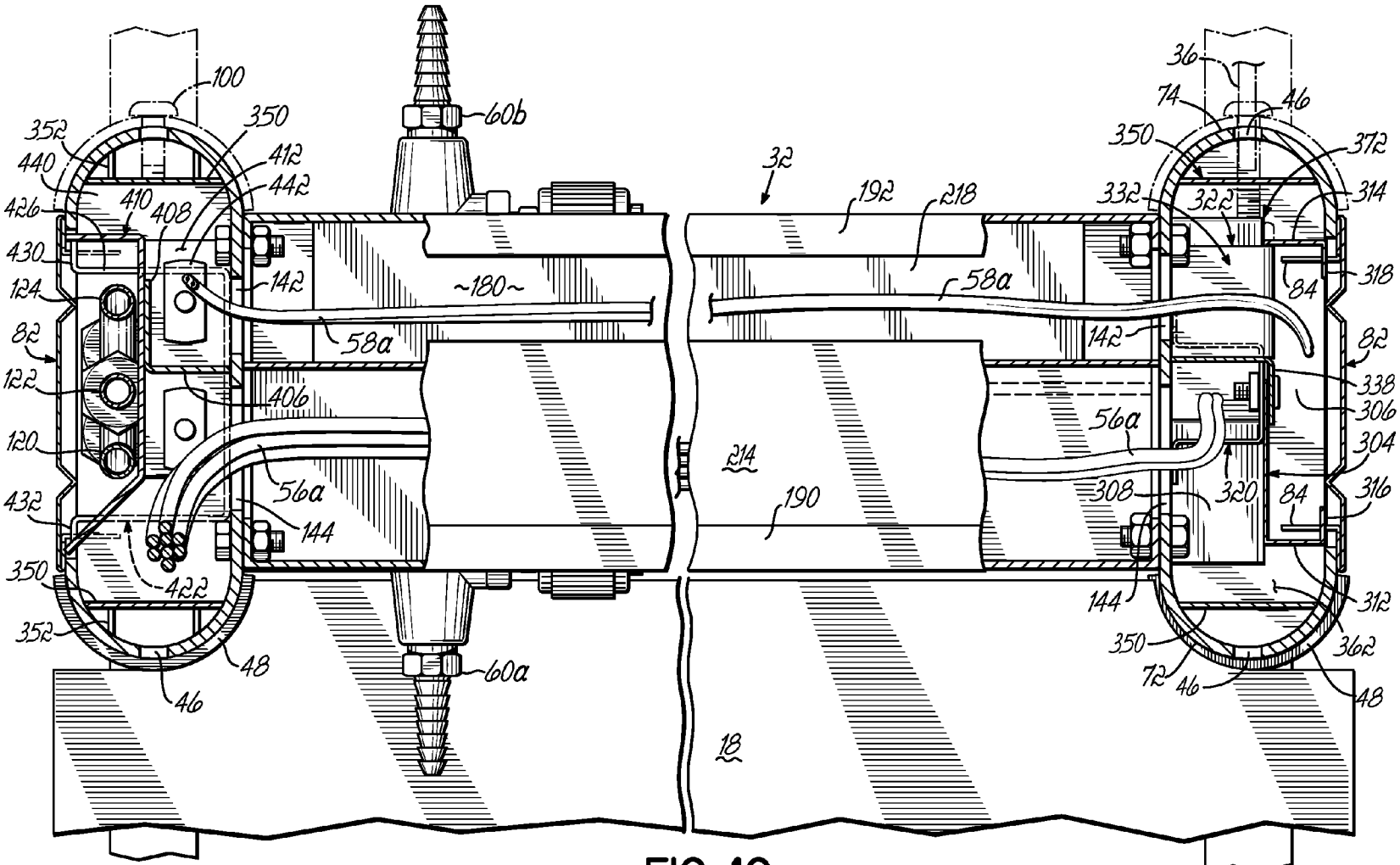
FIG. 10 is a partial cross-sectional plan view of a modular furniture system having vertical frame members as depicted in FIGS. 8A, 8B, 12 and 13.
Figure 11A:
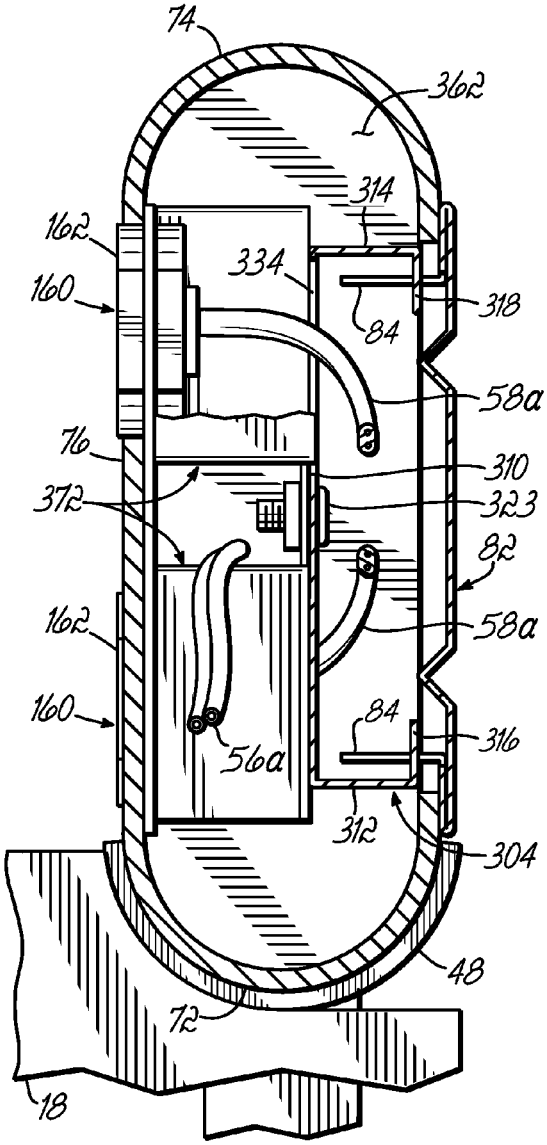
FIG. 11A is a cross-sectional view of the horizontal frame member of FIG. 9B, taken along line 11A-11A.
Figure 11B:
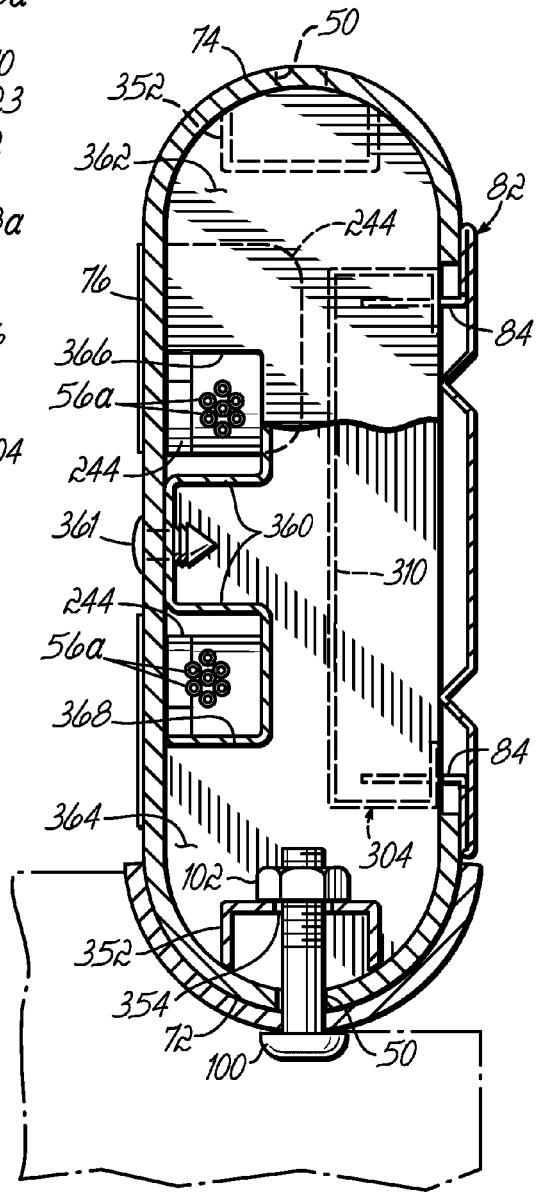
FIG. 11B is a cross-sectional view of the horizontal frame member of FIG. 9B, taken along line 11B-11B.

With continued reference to FIGS. 8A and 8B, and referring further to FIGS. 9A, 9B and 10, the vertical frame member 300 further includes an intermediate partition 304 disposed within interior channel 80 and extending along at least a portion of the elongate tubular section 70. The intermediate partition 304 defines at least two distinct passages 306, 308 (FIGS. 10, 11A, 11B) along the interior channel 80 for routing the various utility service lines through the vertical frame member 300. In the embodiment shown, electric service wires 56*a* from the horizontal frame member 32 are routed through an electric service aperture 144 formed in the sidewall 76 of the elongate tubular section 70 and extend downwardly within the interior channel 80 through a first passage 306 disposed between the sidewall 76 and the intermediate partition 304. Similarly, data service wires 58*a* from horizontal frame member 32 extend through a data service aperture 142 provided in sidewall 76 of the elongate tubular section 70 and are thereafter routed downwardly within the interior channel 80 and through a second passage 308 between the intermediate partition 304 and cover panel 82 to appropriate data outlets 160 having data ports 162 thereon, in a manner similar to that described above.

In the embodiment shown, the intermediate partition 304 comprises a sidewall 310 with spaced, opposing end walls 312, 314 extending generally perpendicularly therefrom. Flanged portions 316, 318 are provided along the respective end walls 312, 314 and extend toward one another along a direction generally parallel to the sidewall 310. A plurality of apertures 302 provided on the flanged portions 316, 318 of the intermediate partition 304 are spaced and arranged to register with the tabs 84 on cover panel 82, whereby cover panel 82 may be mounted over the interior channel 80 in a manner similar to that described above.

In the embodiment shown, one or more standoffs 320 are provided on the sidewall 76 of the elongate tubular section 70 for supporting the intermediate partition 304 within the interior channel 80, between the sidewall 76 and the cover panel 82. The standoffs 320 comprise generally hat-shaped sections having end walls 322 spaced from the sidewall 76 of the elongate tubular section 70. The intermediate partition 304 is secured to the standoffs 320 by fasteners 323 inserted through corresponding apertures 324, 326 in the end wall 322 and the sidewall 310 of the intermediate partition 304. Accordingly, cover panel 82 may be removed from the elongate tubular section 70 to permit limited access to the interior channel 80 for routing or rerouting data service wires 58*a* along the interior channel 80. With the intermediate partition 304 secured within the interior channel 80, electric service wires 56*a* are disposed behind the intermediate partition 304 and within the first passage 306 such that the electric service wires 56*a* remain covered by the intermediate partition 304. When access to the electric service wires 56*a* is required, the intermediate partition 304 may be removed by removing the fasteners 323 and withdrawing the intermediate partition 304 from the interior channel 80.

In the embodiment shown, a notched opening 330 is provided in an upper portion of the intermediate partition 304 and a cable shroud 332 is disposed between the data service aperture 142 and the intermediate partition 304 to facilitate routing data service wires 58*a* from the horizontal frame member 32 into the second passage 308 along the interior channel 80. In the embodiment shown, the cable shroud 332 comprises a generally L-shaped bracket having a vertical wall 334 and a horizontal wall 336 extending substantially perpendicularly therefrom. The cable shroud 332 further includes first and second flanged portions 338, 340 extending from the vertical and horizontal walls 334, 336, respectively, for abutting the sidewall 310 of the intermediate partition 304. The cable shroud 332 maintains separation between the electric service wires 56*a* and the data service wires 58*a* as the respective service lines are routed from the horizontal frame member 32 into the vertical frame member 300.

Referring to FIGS. 8A, 8B, 9A, 9B, 10 and 11B, the vertical frame member 300 further includes upper and lower dividers 350, 352 extending along the tubular section 70 and proximate the apertures 46, 50, respectively. In the embodiment shown, the upper dividers 350 (FIGS. 8A, 9A and 10) comprise elongate, generally flat plates disposed adjacent the ends 72, 74 of tubular section 70 and extending lengthwise along tubular section 70 to at least overlie apertures 46 on the oppositely disposed sides of vertical frame member 300. The upper dividers 350 ensure that brackets for mounting shelves 36 or other accessories to the vertical frame member 300 are isolated from contacting or otherwise engaging the utility service wires routed through the vertical frame member 300. The lower dividers 352 (see FIGS. 8B, 9B and 11B) comprise generally elongate channel sections disposed adjacent the ends 72, 74 of the tubular section 70, and extend along the tubular section 70 at least a length to overlie apertures 50 on the oppositely disposed sides of the vertical frame member 300. A plurality of apertures 354 are provided on the lower dividers 352 and are positioned in registry with corresponding apertures 50 formed through the ends 72, 74 of the channel section 70. One or more nuts 102 may be secured to the lower dividers 352 adjacent the respective apertures 354 to facilitate threadably receiving fasteners 100 for attaching brackets 48 to the vertical framing member 300. The lower dividers 352 thus provide additional structural strength to the vertical frame member 300 for receiving the fasteners 100 at this location.

As depicted in FIGS. 8B and 9B, the vertical framing member 300 further includes a pair of elongate channel members 360 disposed within the interior channel 80 adjacent the sidewall 76 of section 70 for receiving utility service wires through the channel members 360. In the embodiment shown, channel members 360 are formed from a single sheet of material (FIG. 11B) and are secured to sidewall 76 by a fastener 361. It will be recognized that channel members 360 may alternatively comprise separate and individual channel structures.

The channel members 360 extend along a length of the tubular section 70 corresponding to the location of apertures 50. The utility service wires may be routed through the channel members 360 to positions below the apertures 50 while ensuring that contact between the utility service wires and fasteners 100 through apertures 50 is avoided. One or more horizontal divider plates 362, 364 may be provided within the interior channel 80, adjacent oppositely disposed ends of the elongate channel members 360 to further isolate that portion of the interior channel 80 proximate the apertures 50 from other parts of the interior channel 80. In the embodiment shown, the horizontal divider plates 362, 364 include apertures 366, 368 aligned with the ends of the channel members whereby the electric service wires 56*a* may be routed through the apertures 366, 368 and the channel members 360 as depicted in FIGS. 8B and 9B.

With reference to FIGS. 8A, 8B, 9A, 9B, 10, 11A, 11B electric and data service wires 56*a*, 58*a* from horizontal framing member 32 are routed through respective electric and data service apertures 142, 144 into the interior channel 80 of the vertical framing member 300. The electric service wires 56*a* are then routed downwardly through the first passage 306 defined by the tubular section 70 and the intermediate partition 304 and around the standoffs 320. One or more of the electric service wires 56*a* may be routed through the electric service aperture 166 (FIG. 8A) and into horizontal framing member 34, to be coupled with electric outlets 244 (FIG. 8A) provided on horizontal framing member 34, in a manner similar to that described above. Other electric service wires 56*a* may be routed further along the interior channel 80 to electric service outlets 244 provided adjacent the lower end 40 of the vertical frame member 300, as depicted in FIGS. 8B and 9B. As shown therein, the electric service wires 56*a* extend downwardly through the first passage 306 of the interior channel 80, through the apertures 366, 368 provided in the upper and lower horizontal divider plates 362, 364, and through the channel members 360.

In the embodiment shown, intermediate partition 304 extends downwardly along the tubular section 70 and terminates at the upper horizontal divider plate 362. The vertical frame member 300 may further include a lower partition 370, between the sidewall 76 and cover panel 82, and extending between the lower horizontal divider plate 364 and the bottom end 40 of the tubular section 70. The lower partition 370 is similar to the intermediate partition 304, and similar features are similarly numbered.

The lower partition 370 is secured to at least one standoff 320, in the manner described above for intermediate partition 304, so that the lower partition 370 is spaced between sidewall 76 of tubular section 70 and cover plate 82. Accordingly, lower partition 370 remains secured within interior channel 80 after cover plate 82 is removed, thereby keeping electrical service wires 56*a* from being exposed until lower partition 370 is subsequently removed.

The vertical frame member 300 may further include data outlet shrouds 372 disposed adjacent apertures 164 formed in the sidewall 76 of the tubular section 70 at locations for mounting data outlets 160 to the vertical frame member 300. The data outlet shrouds 372 isolate the data outlets 160 from the electric service wires 56*a*. In the embodiment shown, the data outlet shrouds 372 comprise generally C-shaped members disposed adjacent respective pairs of apertures 164 (FIG. 8B) for receiving the data outlets. The data outlet shrouds 372 are spaced from one another to provide a path for routing the electric service wires 56*a* downwardly therebetween.

With continued reference to FIGS. 8A, 8B, 9A, 9B, 10, 11A and 11B, data service wires 58*a* extending through the data service aperture 142 are routed across the cable shroud 332 provided at the upper end 42 of the tubular section 70 and are thereafter routed downwardly along the second passage 308 defined by the intermediate partition 304 to appropriate data outlets 160 (FIG. 9B) mounted within the interior channel 80 of the tubular section 70. The data service wires 58*a* are directed through apertures 374, 376 (FIG. 8B) formed through the sidewall 310 of the intermediate partition 304 and into the data outlet shrouds 372. Accordingly, the data service wires 58*a* remain isolated from the electrical service wires 56*a* as they are directed through the intermediate partition 304 and are coupled to appropriate data outlets 160 mounted within the interior channel 80 and having data ports extending through data apertures 164 in sidewall 76, as described above.

Figure 12:
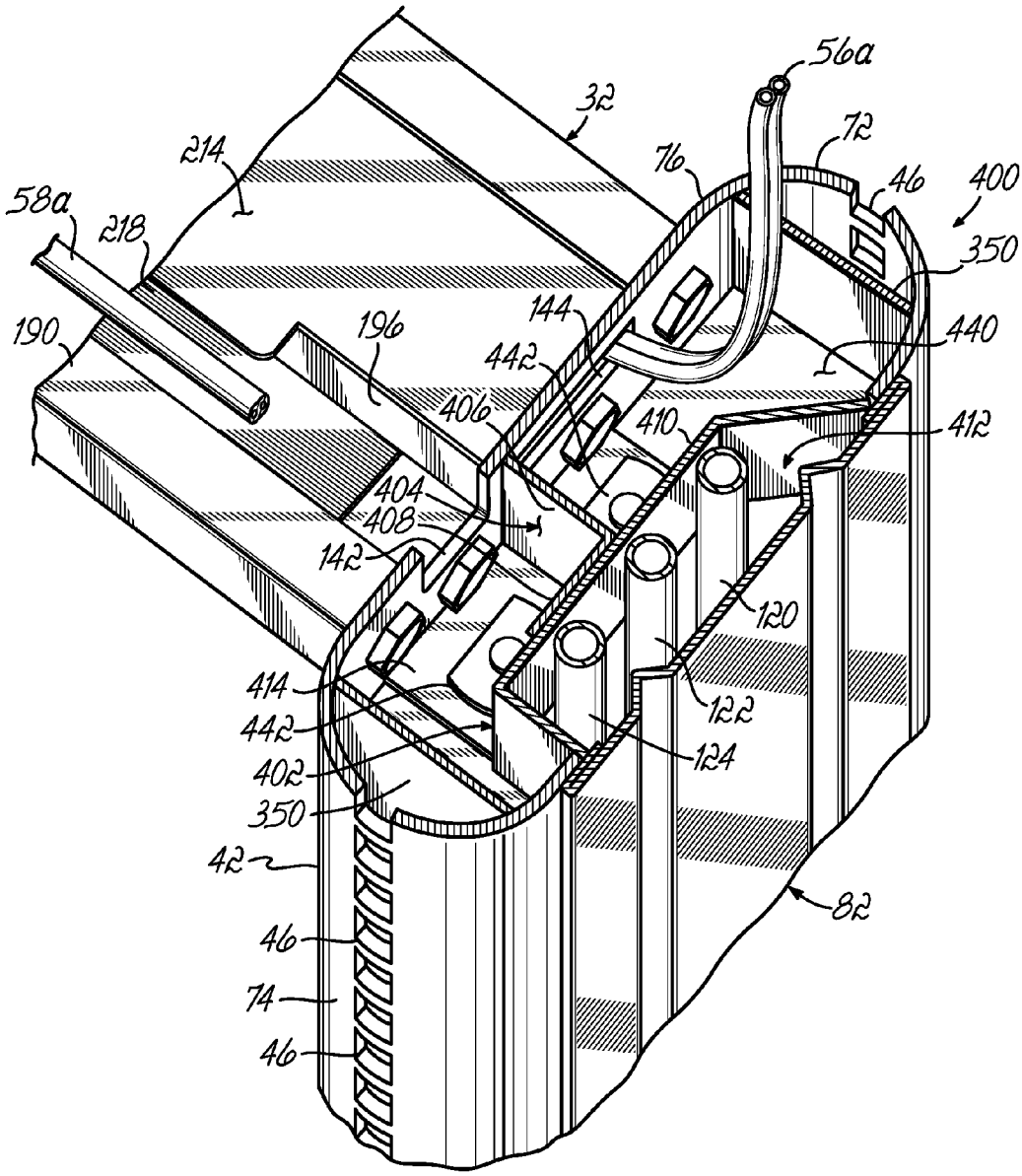
FIG. 12 is a partial cross-sectioned perspective view illustrating horizontal and vertical frame members of a modular furniture system of a third embodiment in accordance with the principles of the present invention.
Figure 13:
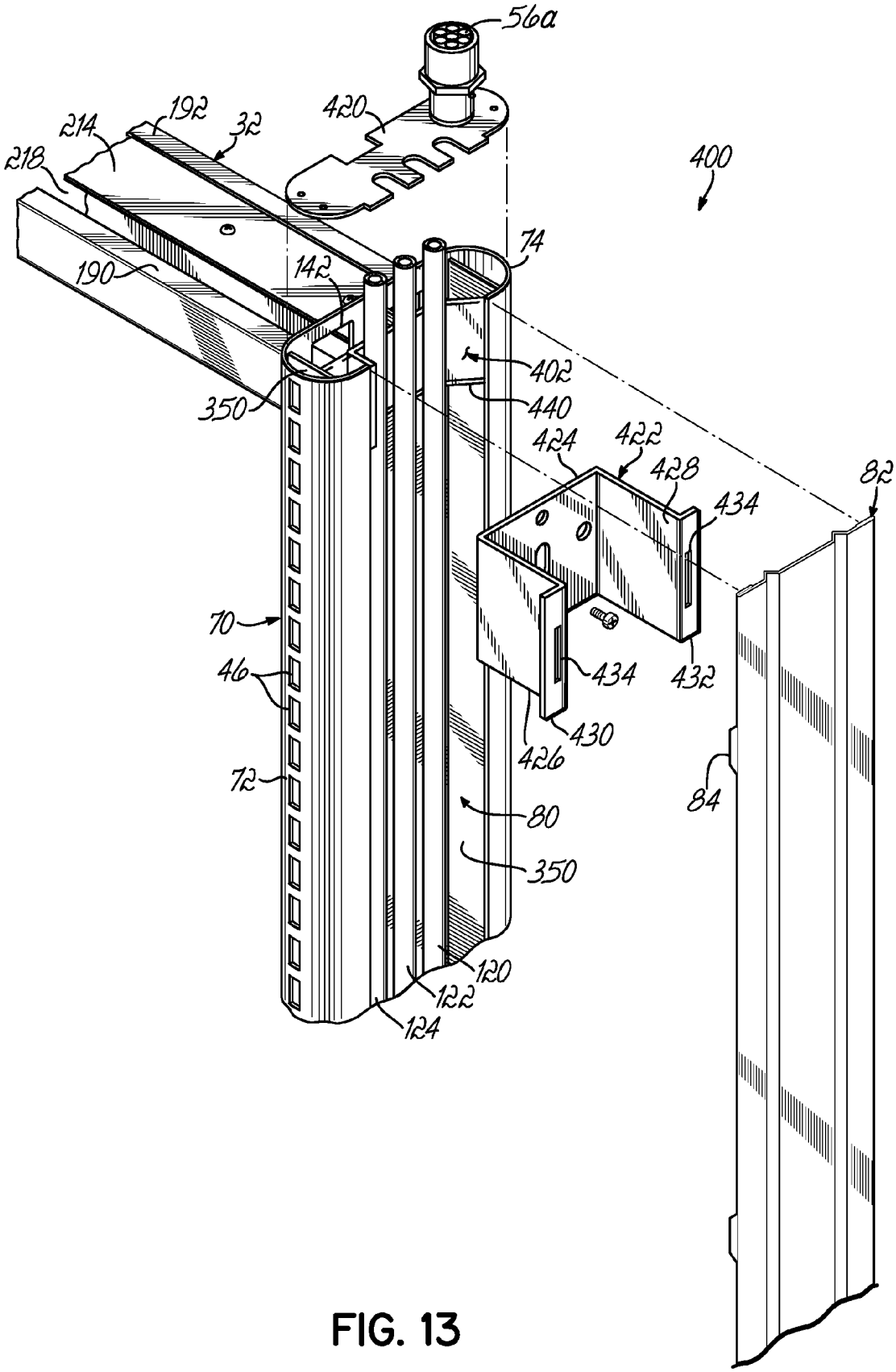
FIG. 13 is an exploded partial perspective view of the horizontal and vertical frame members of FIG. 12.

Referring now to FIGS. 12 and 13, there is shown another exemplary embodiment of a vertical frame member 400 for routing conduits 120, 122, 124 from fluid service line 54 to one or more fluid service fixtures 60 (FIGS. 1, 1A, 2) provided adjacent the respective work surfaces 18, 20. Vertical frame member 400 is similar to vertical frame member 22*b* discussed above, and similar components have been similarly numbered. In the embodiment shown, the vertical frame member 400 includes a cable shroud 402 disposed within the interior channel 80 for separating electric and data service wires 56*a*, 58*a* from the conduits 120, 122, 124 of the fluid service line 54. In the embodiment shown, the cable shroud 402 comprises a first, generally L-shaped first portion 404 having a first leg 406 disposed between the electric service aperture 142 and the data service aperture 144 formed into the sidewall 76 of the tubular section 70. The second leg 408 of the L-shaped first portion 404 extends substantially perpendicularly from the first leg 406 and abuts a generally C-shaped second portion 410 that extends between the first portion 404 and the cover panel 82 to define a passage 412 through which the conduits 120, 122, 124 of the fluid service line 54 extend in a direction toward the lower end 40 of the tubular section 70. A generally horizontal bottom wall 414 of the cable shroud 402 is disposed beneath the first and second portions 404, 410 and extends generally between the second portion 410 and the sidewall 76 of the elongate tubular section 70. Accordingly, electric and data service wires 56*a*, 58*a* extending downwardly into the upper end 42 of the vertical frame member 400 through an end cap 420 are separated by the cable shroud 402 whereafter they are routed through the respective data service aperture 142 and electric service aperture 144 and through the horizontal frame member 32 in a manner similar to that described above. Similarly, the conduits 120, 122, 124 of the fluid service line 54 extend through the end cap 420 from a location above the modular furniture system 10, 10*a* and are separated from the electric and data service wires 56*a*, 58*a* by the cable shroud 402. The separate conduits 120, 122, 124 are routed downwardly through the elongate tubular section 70 to respective fluid service fixtures 60 mounted along the vertical frame member 400 in a manner similar to that described above.

The vertical frame member 400 further includes one or more cover plate support brackets 422 disposed within the elongate tubular section 70 and adjacent the sidewall 76. In the embodiment shown, the cover plate support bracket 422 is a generally C-shaped bracket having a sidewall 424 and oppositely disposed end walls 426, 428 extending generally perpendicularly therefrom in a direction toward the cover plate 82. Flanges 430, 432 are disposed on the outwardly facing ends of the respective end walls 426, 428. Apertures 434 provided in the flanges 430, 432 are positioned for registry with the tabs 84 disposed on the cover plate 82 whereby the cover plate 82 may be mounted to the vertical frame member 400 with the tabs 84 extending through the apertures 434 in a manner similar to that described above.

In the embodiment shown, the vertical frame member 400 further includes a horizontal divider plate 440 disposed between the cable shroud 402 and one of the cover plate support brackets 422 to further isolate the conduits 120, 122, 124 of the fluid service line 54 from the electric and data service wires 56*a*, 58*a*. The horizontal divider plate 440 and the cable shroud 402 may be threadably coupled to one another by fasteners extending through respective apertures formed in the horizontal divider plate 440 and the bottom wall 414 of the cable shroud 402. The fasteners may be secured to nut plates 442 disposed on the cable shroud 402, as depicted in FIGS. 10 and 12.

A modular furniture system in accordance with the principles of the present invention provides a common or unitary framework assembly with vertical frame members that can be shared by back-to-back workstations. The vertical and horizontal frame members of the framework assembly may be configured to facilitate routing various utility service lines to portions of the modular furniture system as may be desired, while concealing the utility service lines for an aesthetically pleasing appearance. The modular furniture system may be provided with accessories, such as shelves, cabinets, tack boards, dividers, and various other accessories, which can be arranged as desired to suit the particular needs of its users.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another;

a free-standing common framework comprising a pair of vertical frame members configured to support said first and second work surfaces, each said vertical frame member comprising a single elongate tubular member;

said first and second work surfaces each attached to said pair of vertical frame members proximate said second side edges, with said pair of vertical frame members being located at respective free lateral side edges of said respective first and second work surfaces so that said respective second side edges of said first and second work surfaces extend between said pair of vertical frame members;

each of said first and second work surfaces being continuous along a respective longitudinal length thereof between said pair of vertical frame members;

a first pair of leg members coupled to said first work surface proximate said first side edge thereof;

a second pair of leg members coupled to said second work surface proximate said first side edge thereof; and at least one utility service line routed through at least a portion of said framework.

2. The modular furniture system of claim 1, wherein at least one of said vertical frame members comprises:

an elongate tubular section defining an interior channel therethrough and an open side that facilitates accessing said interior channel; and a selectively removable panel covering said open side to enclose said interior channel.

3. The modular furniture system of claim 2, wherein said panel is mechanically coupled to said elongate tubular section without fasteners extending therebetween.

4. The modular furniture system of claim 3, further comprising an end cap removably coupled to a terminal end of said elongate tubular section.

5. The modular furniture system of claim 2, further comprising at least one partition disposed in said interior channel of said at least one vertical frame member and extending along at least a portion of said elongate tubular section, said partition defining discrete passages along said interior channel.

6. The modular furniture system of claim 5, wherein said partition is selectively removable from said interior channel.

7. The modular furniture system of claim 5, wherein said at least one partition defines at least three discrete passages along said interior channel.

8. The modular furniture system of claim 5, further comprising electric service wires and data service wires disposed within said at least one vertical frame member, said electric service wires being contained within at least one of said discrete passages and said data service wires being contained within at least one other one of said discrete passages.

9. The modular furniture system of claim 8, wherein said selectively removable panel is removable to permit access to said data service wires while said electric service wires remain covered by said partition.

10. The modular furniture system of claim 9, wherein said partition is selectively removable from said interior channel to permit access to said electric service wires.

11. The modular furniture system of claim 5, further comprising:

at least one first plurality of apertures on said at least one vertical frame member and positioned adjacent said first workstation for mounting accessories to said at least one vertical frame member;

at least one second plurality of apertures on said at least one vertical frame member and positioned adjacent said second workstation for mounting accessories to said at least one vertical frame member;

a first wall structure within said interior channel and adjacent said first plurality of apertures to limit the egress of fastening structure through said first plurality of apertures into said interior channel; and a second wall structure within said interior channel and adjacent said second plurality of apertures to limit the egress of fastening structure through said second plurality of apertures into said interior channel.

12. The modular furniture system of claim 5, further comprising:

at least one gas service conduit disposed within said at least one vertical frame member; and at least one gas service port provided on said at least one vertical frame member and fluidly coupled to said gas service conduit.

13. The modular furniture system of claim 12, further comprising:

at least one of electric service wires and data service wires disposed within said at least one vertical frame member;

said gas service conduit being disposed in one of said passages and at least one of said electric service wires and said data service wires being disposed in at least one other one of said discrete passages.

14. The modular furniture system of claim 1, further comprising at least one utility service line, and wherein said at least one vertical frame member is configured to receive said at least one utility service line from a location spaced from a terminal end of said at least one vertical frame member.

15. The modular furniture system of claim 14, further comprising:

at least one end cap coupled to said terminal end of said at least one vertical frame member and receiving said at least one utility service line therethrough.

16. The modular furniture system of claim 1, wherein said common framework further comprises:

at least one horizontal frame member extending between said pair of vertical frame members and having first and second opposed sides, said first side generally facing said first workstation and said second side generally facing said second workstation; and at least one of a first electric service outlet and a second electric service outlet associated with said horizontal frame member;

said first electric service outlet being associated with said first side of said horizontal frame member and facing said first workstation; and said second electric service outlet being associated with said second side of said horizontal frame member and facing said second workstation.

17. The modular furniture system of claim 16, wherein said at least one first and second electric service outlet is mounted within said horizontal frame member by fasteners such that said fasteners are concealed from view externally of said horizontal frame member.

18. The modular furniture system of claim 16, further comprising first and second electric service outlets associated with said horizontal frame member.

19. The modular furniture system of claim 18, wherein said first and second service outlets are mounted within said horizontal frame member by fasteners such that said fasteners are concealed from view externally of said horizontal frame member.

20. The modular furniture system of claim 1, further comprising at least one electric service outlet associated with at least one of said vertical frame members.

21. The modular furniture system of claim 1, wherein each said first and second work surfaces is independently adjustable to vary a height of said respective work surface.

22. The modular furniture system of claim 1, wherein each said elongate tubular member comprises first and second oppositely disposed ends, and a sidewall extending between said first and second ends.

23. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another;

a free-standing common framework comprising a pair of vertical frame members configured to support said first and second work surfaces; and at least one utility service line routed through at least a portion of said framework;

wherein said common framework further comprises:

at least one horizontal frame member extending between said pair of vertical frame members and having first and second opposed sides, said first side generally facing said first workstation and said second side generally facing said second workstation; and at least one of a first electric service outlet and a second electric service outlet associated with said horizontal frame member;

said first electric service outlet being associated with said first side of said horizontal frame member and facing said first workstation; and said second electric service outlet being associated with said second side of said horizontal frame member and facing said second workstation;

wherein said at least one first and second electric service outlet is mounted within said horizontal frame member by fasteners such that said fasteners are concealed from view externally of said horizontal frame member; and wherein said horizontal frame member comprises:

an elongate tubular member defining an interior channel therealong and having an open side for accessing said interior channel;

first and second outlet support members configured to mount said at least one first and second electric service outlets; and said first and second outlet support members being coupled together for movement toward and away from each other between a first position wherein said outlet support members are insertable into said interior channel through said open side of said horizontal frame member, and a second position wherein said first and second outlet support members are captured within said interior channel of said horizontal frame member.

24. The modular furniture system of claim 23, wherein said first and second outlet support members are slidably coupled together for movement toward and away from each other.

25. The modular furniture system of claim 23, further comprising a horizontal frame member cover removably mounted to said elongate tubular member and covering said open side.

26. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another;

a free standing common framework comprising a pair of vertical frame members configured to support said first and second work surfaces and at least one horizontal frame member extending between said pair of vertical frame members, each said vertical frame member comprising a single elongate tubular member and said horizontal member having a longitudinal axis and first and second oppositely disposed sides located on opposite transverse sides of said longitudinal axis and facing in opposite directions;

said first and second work surfaces each attached to said pair of vertical frame members proximate said second side edges, with said pair of vertical frame members being located at respective free lateral side edges of said respective first and second work surfaces so that said respective second side edges of said first and second work surfaces extend between said pair of vertical frame members;

each of said first and second work surfaces being continuous along a respective longitudinal length thereof between said pair of vertical frame members;

at least one first electric service outlet disposed on said first side of said horizontal frame member and facing said first workstation, said first electric service outlet including at least one electrical socket; and at least one second electric service outlet disposed on said second side of said horizontal frame member and facing said second workstation, said second electric service outlet including at least one electrical socket.

27. The modular furniture system of claim 26, wherein said first and second electric service outlets are mounted within said horizontal frame member by fasteners such that said fasteners are concealed from view externally of said horizontal frame member.

28. A modular furniture system, comprising:

a framework comprising at least one horizontal frame member, said horizontal frame member having a longitudinal axis and first and second oppositely disposed sides located on opposite transverse sides of said longitudinal axis and facing in opposite directions;

at least first and second workstations disposed beneath and on said opposite sides of said horizontal frame member with said first workstation facing said first side and said second workstation facing said second side;

at least one first electric service outlet disposed on said first side of said horizontal frame member and facing said first workstation, said first electric service outlet including at least one electrical socket; and at least one second electric service outlet disposed on said second side of said horizontal frame member and facing said second workstation, said second electric service outlet including at least one electrical socket;

wherein said first and second electric service outlets are mounted within said horizontal frame member by fasteners such that said fasteners are concealed from view externally of said horizontal frame member; and wherein said horizontal frame member comprises:

an elongate tubular member defining an interior channel therealong and having an open side for accessing said interior channel; and first and second outlet support members configured to mount said first and second electric service outlets;

said first and second outlet support members being coupled together for movement toward and away from each other between a first position wherein said outlet support members are insertable into said interior channel through said open side of said horizontal frame member, and a second position wherein said first and second outlet support members are captured within said interior channel of said horizontal frame member.

29. The modular furniture system of claim 28, wherein said first and second outlet support members are slidably coupled together for movement toward and away from each other.

30. The modular furniture system of claim 28, further comprising a horizontal frame member cover removably mounted to said elongate tubular member and covering said open side.

31. The modular furniture system of claim 28, comprising:

at least one first outlet aperture in said first side of said tubular member;

at least one second outlet aperture in said second side of said tubular member;

said at least one first electric service outlet being supported by said first outlet support member in alignment with said first outlet aperture; and said at least one second electric outlet being supported by said second outlet support member in alignment with said second outlet aperture;

said first and second electric service outlets being positioned adjacent said first and second outlet apertures, respectively, when said outlet support members are moved to said second position.

32. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another; and a free-standing framework comprising a pair of vertical frame members configured to support each of said first and second work surfaces, each said vertical frame member comprising a single elongate tubular member and extending above said first and second workstations and being free of floor support structure extending laterally outwardly from said vertical frame members;

wherein at least one of said vertical frame members comprises:

an elongate tubular section defining an interior channel therethrough and an open side that facilitates accessing said interior channel;

an opening proximate a terminal end of said elongate tubular section, said opening configured to receive utilities into said tubular section from a position above said vertical frame member; and a selectively removable panel covering said open side to enclose said interior channel.

33. The modular furniture system of claim 32, further comprising at least one partition disposed in said interior channel of said at least one vertical frame member and extending along at least a portion of said elongate tubular section, said partition defining discrete passages along said interior channel.

34. The modular furniture system of claim 33, wherein said partition is selectively removable from said interior channel.

35. The modular furniture system of claim 33, further comprising electric service wires and data service wires disposed within said at least one vertical frame member, said electric service wires being contained within at least one of said discrete passages and said data service wires being contained within at least one other one of said discrete passages.

36. The modular furniture system of claim 35, wherein said selectively removable panel is removable to permit access to said data service wires while said electric service wires remain covered by said partition.

37. The modular furniture system of claim 36, wherein said partition is selectively removable from said interior channel to permit access to said electric service wires.

38. The modular furniture system of claim 33, further comprising:

at least one gas service conduit disposed within said at least one vertical frame member; and at least one gas service port provided on said at least one vertical frame member and fluidly coupled to said gas service conduit.

39. The modular furniture system of claim 38, further comprising:

at least one of electric service wires and data service wires disposed within said at least one vertical frame member;

said gas service conduit being disposed in one of said passages and at least one of said electric service wires and said data service wires being disposed in at least one other one of said discrete passages.

40. The modular furniture system of claim 32, further comprising at least one utility service line, and wherein said at least one vertical frame member is configured to receive said at least one utility service line from a location spaced from a terminal end of said at least one vertical frame member.

41. The modular furniture system of claim 40, further comprising:

at least one end cap coupled to said terminal end of said at least one vertical frame member and receiving said at least one utility service line therethrough.

42. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another;

a free-standing common framework comprising a pair of vertical frame members configured to support said first and second work surfaces, each said vertical frame member comprising a single elongate tubular member;

said first and second work surfaces each attached to said pair of vertical frame members proximate said second side edges, with said pair of vertical frame members being located at respective free lateral side edges of said respective first and second work surfaces so that said respective second side edges of said first and second work surfaces extend between said pair of vertical frame members;

each of said first and second work surfaces being continuous along a respective longitudinal length thereof between said pair of vertical frame members; and at least one utility service line routed through at least a portion of said framework.

43. A modular furniture system, comprising:

first and second discrete, independent work surfaces defining respective first and second workstations, each of said first and second work surfaces having respective first and second oppositely disposed side edges, said first and second work surfaces being oriented back-to-back such that said first side edges face away from one another and said second side edges confront one another;

a free-standing common framework comprising a pair of vertical frame members configured to support said first and second work surfaces, each said vertical frame member comprising a single elongate tubular member and being free of floor support structure extending laterally outwardly from said vertical frame members; and at least one utility service line routed through at least a portion of said framework.

* * * * *

UNITED STATES PATENT AND TRADEMARK OFFICE

CERTIFICATE OF CORRECTION

PATENT NO. : 8,186,281 B2
APPLICATION NO. : 11/276525
DATED : May 29, 2012
INVENTOR(S) : John M. Bastian It is certified that error appears in the above-identified patent and that said Letters Patent is hereby corrected as shown below:

In column 3, line 23, change "each work surface 18, 20 have oppositely disposed first and second side edges" to --each work surface 18, 20 has oppositely disposed first and second side edges--.

In column 4, line 67, change "which contribute to the stability and rigidity to the framework" to --which contribute to the stability and rigidity of the framework--.

In column 16, claim 21, line 48, change "wherein each said first and second work surfaces is" to --wherein each said first and second work surface is--.

Signed and Sealed this
Seventh Day of August, 2012

David J. Kappos

David J. Kappos
*Director of the United States Patent and Trademark Office*